US011577364B2

(12) United States Patent
Lee et al.

(10) Patent No.: US 11,577,364 B2
(45) Date of Patent: Feb. 14, 2023

(54) CONDITIONER AND CHEMICAL MECHANICAL POLISHING APPARATUS INCLUDING THE SAME

(71) Applicant: SAMSUNG ELECTRONICS CO., LTD., Suwon-si (KR)

(72) Inventors: Yong-Hee Lee, Seoul (KR); Seung-Chul Han, Suwon-si (KR); Hui-Gwan Lee, Suwon-si (KR); Jong-Hwi Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1059 days.

(21) Appl. No.: 16/225,089

(22) Filed: Dec. 19, 2018

(65) Prior Publication Data

US 2019/0358772 A1 Nov. 28, 2019

(30) Foreign Application Priority Data

May 28, 2018 (KR) ..... 10-2018-0060299

(51) Int. Cl.
*B24B 53/02* (2012.01)
*B24B 53/017* (2012.01)
*B24B 53/00* (2006.01)

(52) U.S. Cl.
CPC ..... *B24B 53/017* (2013.01); *B24B 53/005* (2013.01); *B24B 53/02* (2013.01)

(58) Field of Classification Search
CPC ..... B24B 53/005; B24B 53/017; B24B 53/02; B24D 7/16; B24D 13/14; B24D 13/20; B24D 2201/00
USPC ..... 451/56, 443, 44
See application file for complete search history.

(56) References Cited

U.S. PATENT DOCUMENTS 6,036,583 A * 3/2000 Perlov ..... B24B 53/017 451/56
6,203,414 B1 3/2001 Numoto et al.
6,241,593 B1 6/2001 Chen et al.
6,343,974 B1 * 2/2002 França ..... B24B 49/10 451/10
6,422,928 B1 7/2002 Nakamura et al.
6,592,437 B1 * 7/2003 Boyd ..... B24B 37/30 451/285
6,645,046 B1 * 11/2003 Vogtmann ..... B24B 21/04 451/41
6,824,454 B2 11/2004 Kimura et al.
6,949,016 B1 * 9/2005 de la Llera ..... B24B 21/18 451/285

(Continued)

FOREIGN PATENT DOCUMENTS

CN 107186617 A 9/2017
JP 2001-105307 A 4/2001

(Continued)

OTHER PUBLICATIONS

Chinese Office action dated Oct. 14, 2022.

*Primary Examiner* — Eileen P Morgan
(74) *Attorney, Agent, or Firm* — Lee IP Law, P.C.

(57) ABSTRACT

A conditioner of a chemical mechanical polishing (CMP) apparatus includes a conditioning part to polish a polishing pad, an arm to rotate the conditioning part, and a flexible connector connecting the conditioning part with the arm, the flexible connector being moveable to allow relative movements of the conditioning part with respect to the arm.

18 Claims, 23 Drawing Sheets

(56) References Cited

U.S. PATENT DOCUMENTS

| | | | | |
|---|---|---|---|---|
| 7,097,544 | B1 * | 8/2006 | Tolles | B08B 1/007 257/E21.23 |
| 7,258,600 | B1 * | 8/2007 | Benner | B24B 57/00 451/72 |
| 7,585,205 | B2 * | 9/2009 | Katsuoka | B24B 55/02 451/9 |
| 7,963,826 | B2 | 6/2011 | Nangoy et al. | |
| 8,382,558 | B2 | 2/2013 | Watanabe et al. | |
| 8,398,463 | B2 * | 3/2013 | Bajaj | B24B 53/095 451/56 |
| 9,156,122 | B2 | 10/2015 | Shinozaki et al. | |
| 9,221,149 | B2 * | 12/2015 | Baumann | B24B 53/017 |
| 9,808,908 | B2 | 11/2017 | Shinozaki | |
| 10,434,627 | B2 * | 10/2019 | Attur | B24B 53/017 |
| 10,464,185 | B2 | 11/2019 | Isono et al. | |
| 10,814,457 | B2 * | 10/2020 | Lee | H01L 21/3212 |
| 2014/0113533 | A1 * | 4/2014 | Fung | B24B 53/017 451/443 |
| 2014/0273767 | A1 * | 9/2014 | Chen | B24B 53/017 451/72 |
| 2016/0256976 | A1 * | 9/2016 | Shinozaki | B24B 37/005 |

FOREIGN PATENT DOCUMENTS

| | | | |
|---|---|---|---|
| JP | 2004-090142 | A | 3/2004 |
| JP | 2004-136379 | A | 5/2004 |
| JP | 2015-199171 | A | 11/2015 |
| TW | 431942 | B | 5/2001 |
| TW | I248386 | B | 2/2006 |

* cited by examiner

CONDITIONER AND CHEMICAL MECHANICAL POLISHING APPARATUS INCLUDING THE SAME

CROSS-REFERENCE TO RELATED APPLICATION

Korean Patent Application No. 2018-0060299, filed on May 28, 2018, in the Korean Intellectual Property Office (KIPO), and entitled: "Conditioner and Chemical Mechanical Polishing Apparatus Including the Same," is incorporated by reference herein in its entirety.

BACKGROUND

1. Field

Example embodiments relate to a conditioner and a chemical mechanical polishing apparatus including the same. More particularly, example embodiments relate to a conditioner configured to polish a polishing pad, and a chemical mechanical polishing apparatus including the conditioner.

2. Description of the Related Art

Generally, a layer on a semiconductor substrate may be planarized using a chemical mechanical polishing (CMP) apparatus. The CMP apparatus may include a CMP unit for polishing the layer using a polishing pad, and a conditioning unit for polishing the polishing pad using a conditioning disk. In order to provide for the polishing pad inclined to the conditioning unit, the conditioning unit may include a flexible connection unit.

SUMMARY

According to example embodiments, there may be provided a conditioner of a CMP apparatus. The conditioner may include a conditioning part to polish a polishing pad, an arm to rotate the conditioning part, and a flexible connector connecting the conditioning part with the arm, the flexible connector being moveable to allow relative movements of the conditioning part with respect to the arm.

According to example embodiments, there may be provided a conditioner of a CMP apparatus. The conditioner may include a conditioning unit, an arm unit, a flexible connection unit and a sensor unit. The conditioning unit may be configured to polish a polishing pad. The arm unit may be configured to rotate the conditioning unit. The flexible connection unit may be connected between the conditioning unit and the arm unit to allow a relative movement of the conditioning unit with respect to the arm unit. The flexible connection unit may form an air bag between the arm unit and the conditioning unit. The sensor unit may be configured to measure a tilted angle of the conditioning unit with respect to the arm unit.

According to example embodiments, there may be provided a CMP apparatus. The CMP apparatus may include a plurality of platens, a CMP unit and a conditioner. The platens may be configured to receive polishing pads. The CMP unit may be arranged over the platens to polish a substrate using the polishing pads. The conditioner may include a conditioning unit, an arm unit and a flexible connection unit. The conditioning unit may be configured to polish a polishing pad. The arm unit may be configured to rotate the conditioning unit. The flexible connection unit may be connected between the conditioning unit and the arm unit to allow a relative movement of the conditioning unit with respect to the arm unit.

BRIEF DESCRIPTION OF THE DRAWINGS

Features will become apparent to those of skill in the art by describing in detail exemplary embodiments with reference to the attached drawings, in which.

DETAILED DESCRIPTION

Hereinafter, example embodiments will be explained in detail with reference to the accompanying drawings.

Conditioner

Figure 1:
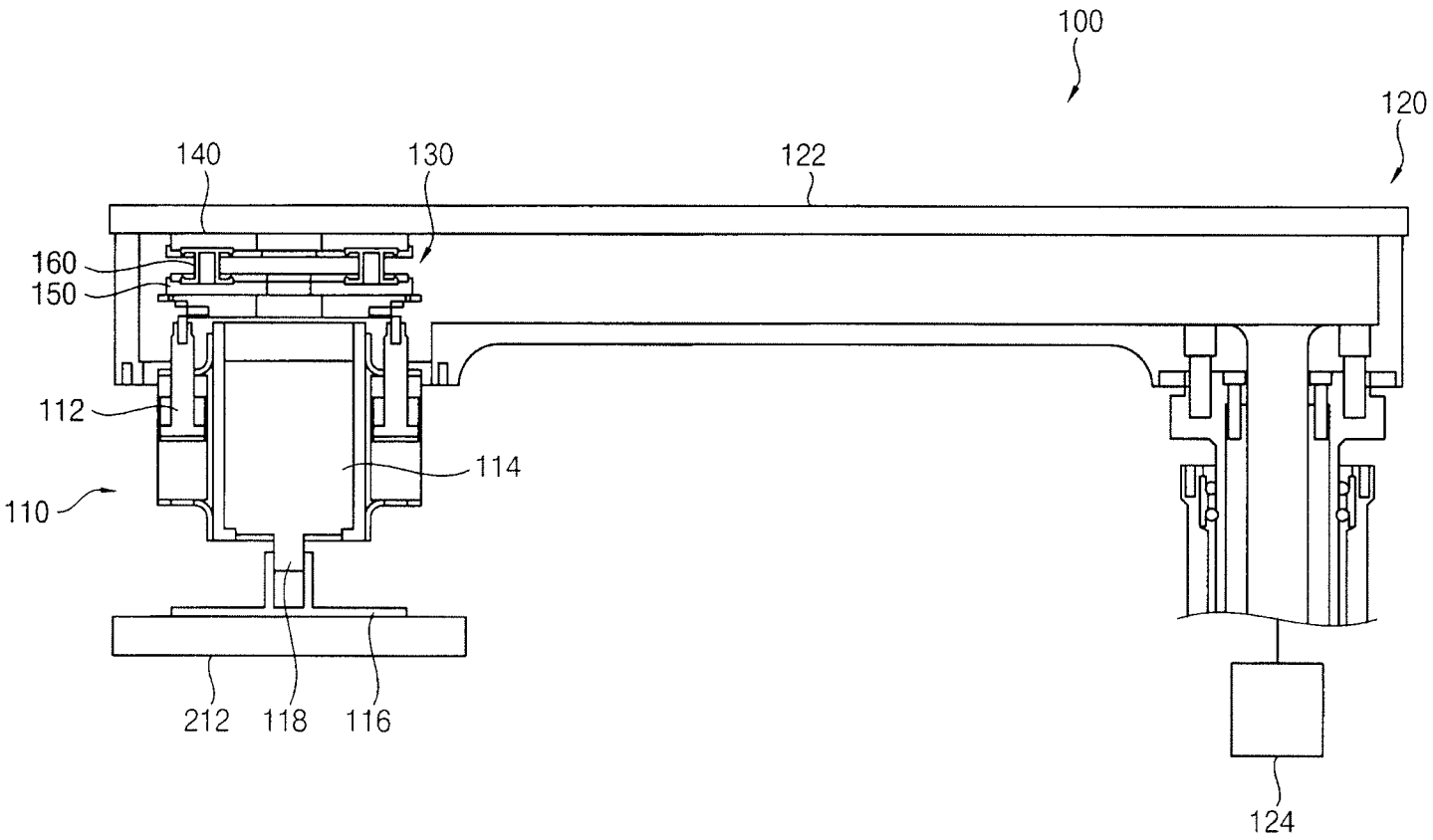
FIG. 1 illustrates a cross-sectional view of a conditioner in accordance with example embodiments.
Figure 2:
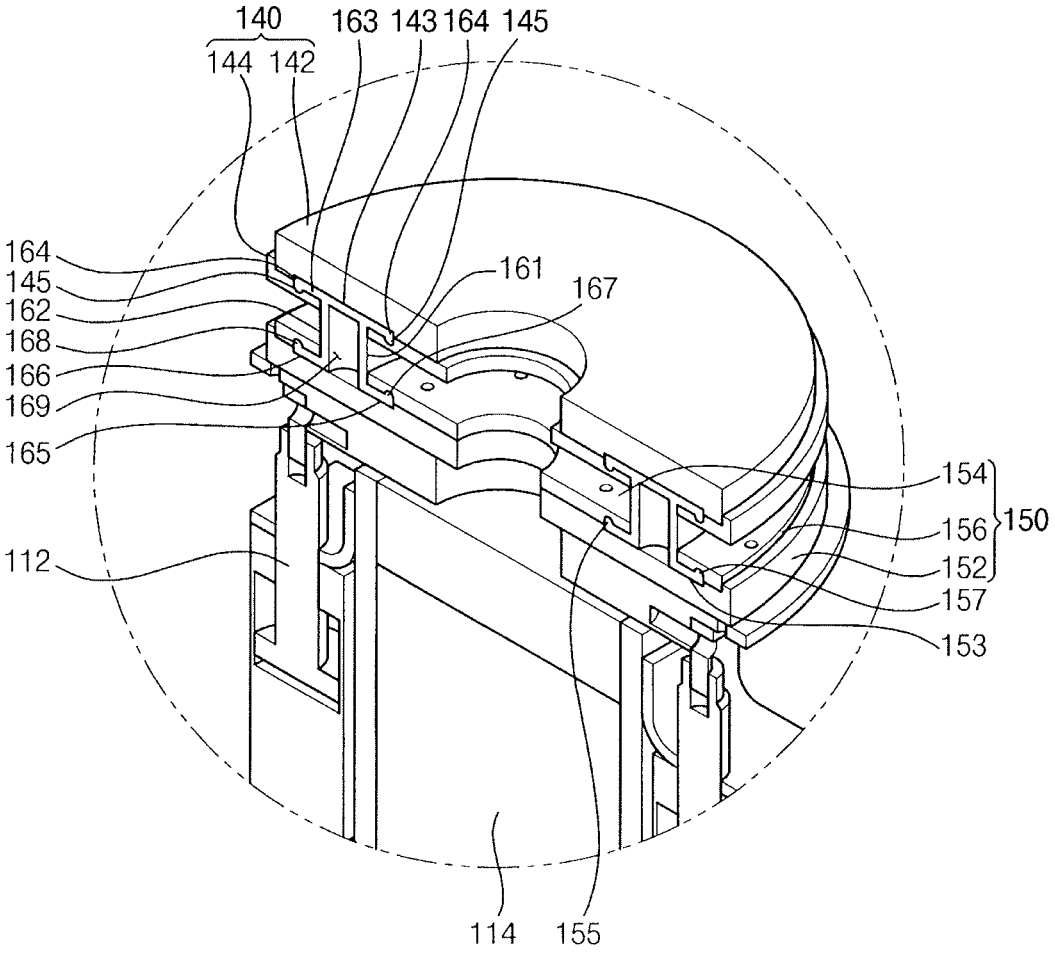
FIG. 2 illustrates an enlarged perspective view of an internal structure of a conditioning unit and a flexible connection unit of the conditioner in FIG. 1.
Figure 3:
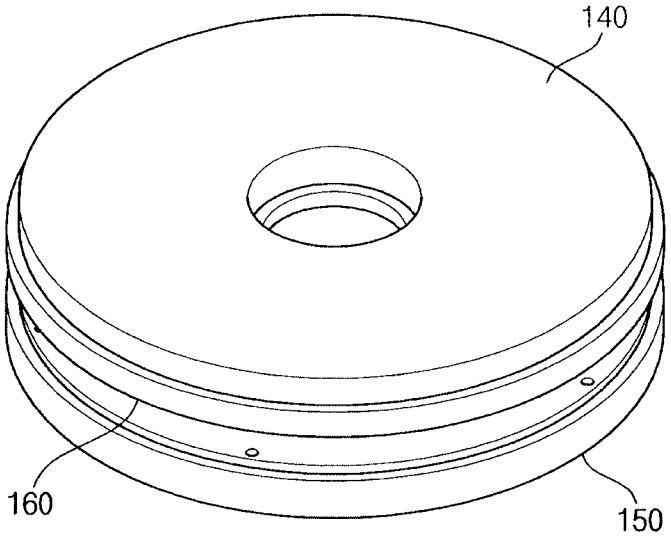
FIG. 3 illustrates a perspective view of the flexible connection unit in FIG. 2.
Figure 4:
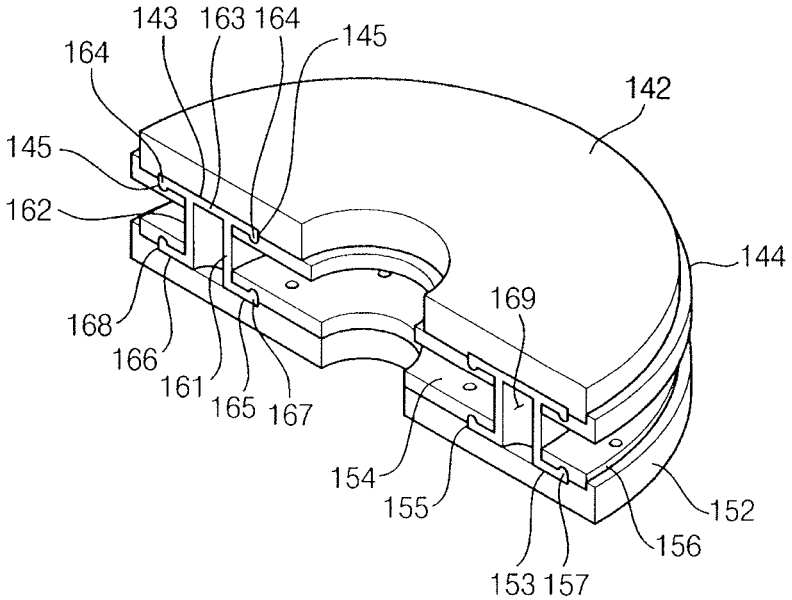
FIG. 4 illustrates a perspective view of an internal structure of the flexible connection unit in FIG. 3.
Figure 5:
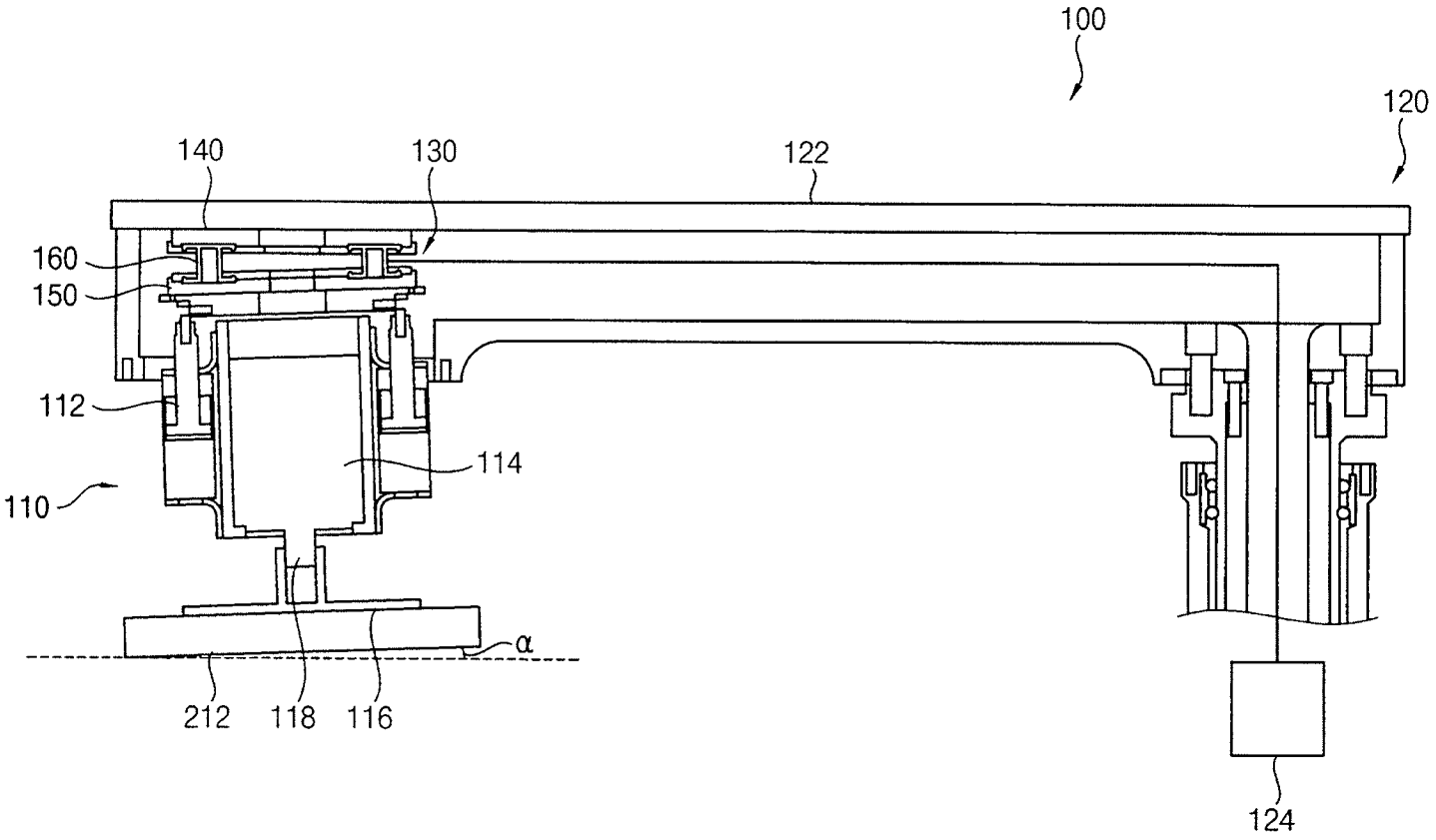
FIG. 5 illustrates a cross-sectional view of operation of the conditioner in FIG. 1.

FIG. 1 is a cross-sectional view illustrating a conditioner in accordance with example embodiments, FIG. 2 is an enlarged perspective view illustrating an internal structure of a conditioning unit and a flexible connection unit of the conditioner in FIG. 1, FIG. 3 is a perspective view illustrating the flexible connection unit in FIG. 2, FIG. 4 is a perspective view illustrating an internal structure of the flexible connection unit in FIG. 3, and FIG. 5 is a cross-sectional view illustrating operations of the conditioner in FIG. 1.

Referring to FIGS. 1 to 5, a conditioner 100 of this example embodiment may include a conditioning unit 110, an arm unit 120, and a flexible connection unit 130.

The conditioning unit 110 may be arranged over a polishing pad 212 configured to polish a layer on a semiconductor substrate. The conditioning unit 110 may include a first actuator 112, a second actuator 114, a conditioning disk 116, and a rotating shaft 118.

The conditioning disk 116 may be arranged over the polishing pad 212. The conditioning disk 116 may be rotated by the rotating shaft 118. The conditioning disk 116 may make contact with an upper surface of the polishing pad 212, while rotating, to polish the upper surface of the polishing pad 212.

The second actuator 114 may be connected with an upper surface of the conditioning disk 116 via the rotating shaft 118. The second actuator 114 may rotate the conditioning disk 116 with respect to the rotating shaft 118. In example embodiments, the second actuator 114 may include a motor.

The first actuator 112 may lift the second actuator 114 in a vertical direction, e.g., up and down relatively to the upper surface of the polishing pad 212. The rotating conditioning disk 116 may pressurize the upper surface of the polishing pad 212 by the vertical force of the first actuator 112. In example embodiments, the first actuator 112 may include a pair of cylinders.

The arm unit 120 may be configured to rotate the conditioning unit 110 with respect to the vertical direction. The arm unit 120 may include an arm 122 connected with the first actuator 112, and an actuator 124 configured to rotate the arm 122.

The arm 122 may be extended in a horizontal direction, e.g., parallel to the upper surface of the polishing pad 212. The first actuator 112 and the actuator 124 may be connected to opposite ends of the arm 122. For example, the first actuator 112 may be connected to a left end of the arm 122 (e.g., in FIG. 1), and the actuator 124 may be connected to a right end of the arm 122 (e.g., in FIG. 1). The actuator 124 may rotate the arm 122 with respect to the right end of the arm 122, e.g., rotate around an axis passing along a vertical direction through the right end of the arm 122. In example embodiments, the actuator 124 may include a motor.

The flexible connection unit 130 may be arranged between the conditioning unit 110 and the arm unit 120. The flexible connection unit 130 may be configured to connect the conditioning unit 110 with the arm unit 120. Particularly, the flexible connection unit 130 may allow a relative movement of the conditioning unit 110 with respect to the arm unit 120. The flexible connection unit 130 may include a first fixing member 140, a second fixing member 150, and a flexible connection member 160.

The first fixing member 140 may be fixed to the arm unit 120. Particularly, the first fixing member 140 may be fixed to the left end of the arm 122. In example embodiments, the first fixing member 140 may have a circular plate shape. However, the shape of the first fixing member 140 may not be restricted to the circular plate.

In example embodiments, the first fixing member 140 may include a first upper plate 142 and a first lower plate 144. The first upper plate 142 may have a lower surface configured to make contact with an upper surface of the first lower plate 144. For example, as illustrated in FIGS. 2 and 4, the first upper and lower plates 142 and 144 may be stacked on top of each other, e.g., the first lower plate 144 may have a larger outermost diameter and a smaller inner most diameter than those of the first upper plate 142.

A first receiving groove 143 may be formed at the lower surface of the first upper plate 142, e.g., the receiving groove 143 may be formed at an interface between the first upper and lower plates 142 and 144. The first receiving groove 143 may be formed in a circumferential direction of the first upper plate 142, e.g., the first receiving groove 143 may extend continuously along an entirety of the innermost diameter of the first upper plate 142. A pair of first combining grooves 145 may be formed at the lower surface of the first lower plate 144, e.g., the pair of the first combining grooves 145 may extend from the first receiving groove 143 into the first lower plate 144. The first combining grooves 145 may be formed in a circumferential direction of the first lower plate 144 e.g., the first combining grooves 145 may extend continuously along an entirety of the innermost diameter of the first upper plate 142. A distance between the first combining grooves 145 may correspond to a width of the first receiving groove 143. That is, the first combining grooves 145 may be positioned adjacent to both ends of the first receiving groove 143.

The second fixing member 150 may be arranged under the first fixing member 140, e.g., the second fixing member 150 may be arranged between the conditioning unit 110 and the first fixing member 140. The second fixing member 150 may be spaced apart from the first fixing member 140. The second fixing member 150 may be fixed to the conditioning unit 110. Particularly, the second fixing member 150 may be fixed to the first actuator 112 of the conditioning unit 110. In example embodiments, the second fixing member 150 may have a circular plate shape. Further, the second fixing member 150 may have a shape and a size substantially the same as those of the first fixing member 140. However, the shape of the second fixing member 150 may not be restricted to the circular plate.

In example embodiments, the second fixing member 150 may include a second lower plate 152, a second inner upper plate 154, and a second outer upper plate 156. The second lower plate 152 may have an upper surface configured to make contact with lower surfaces of the second inner and outer upper plates 154 and 156. For example, as illustrated in FIGS. 2 and 4, the lower surfaces of the second inner and outer upper plates 154 and 156 may be coplanar and on the upper surface of the second lower plate 152, e.g., the second inner and outer upper plates 154 and 156 may be concentric to have the second outer upper plate 156 surround the second inner upper plate 154.

A second receiving groove 153 may be formed at the upper surface of the second lower plate 152, e.g., between the second lower plate 152 and the second inner and outer upper plates 154 and 156. The second receiving groove 153 may be formed in a circumferential direction of the second lower plate 152. The second receiving groove 153 may have a shape substantially the same as that of the first receiving groove 143. The second inner upper plate 154 may be spaced apart from the second outer upper plate 156. A second inner combining groove 155 may be formed at the lower surface of the second inner upper plate 154. A second outer combining groove 157 may be formed at the lower surface of the second outer upper plate 156. The second inner and outer combining grooves 155 and 157 may be formed in circumferential directions of the second inner and outer upper plates 154 and 156, e.g., the second inner and outer combining grooves 155 and 157 may extend from opposite ends of the second receiving groove 153 toward the first receiving groove 143.

Alternatively, the first fixing member 140 may include a single member or at least three members. Similarly, the second fixing member 150 may include a single member, two members or at least four members. For example, as illustrated in FIGS. 2 and 4, the first and second fixing members 140 and 150 may be aligned and overlap each other, and the first and second receiving grooves 143 and 153 may be aligned and overlap each other.

The flexible connection member 160 may be arranged between the first fixing member 140 and the second fixing member 150. The flexible connection member 160 may be configured to connect the second fixing member 150 with the first fixing member 140. Particularly, the flexible connection member 160 may allow the relative movement of the second fixing member 150 with respect to the first fixing member 140. Because the conditioning unit 110 may be connected with the second fixing member 150, the conditioning unit 110 may be relatively moved with respect to the arm unit 120 by the flexible connection member 160.

In example embodiments, the flexible connection member 160 may include a flexible material such as a rubber. The flexible connection member 160 may have an annular shape. The flexible connection member 160 may have an empty internal space 169. The internal space 169 of the flexible connection member 160 may be filled with air. Thus, the internal space 169 of the flexible connection member 160 filled with the air may function as an air bag.

In example embodiments, the flexible connection member 160 may include an inner ring 161, an outer ring 162, an upper combining portion 163, a pair of upper combining protrusions 164, a lower inner combining portion 165, a lower outer combining portion 166, a lower inner combining protrusion 167, and a lower outer combining protrusion 168. The upper combining protrusions 164 and the lower inner and outer combining protrusions 167 and 168 may be formed in a circumferential direction of the flexible connection member 160.

The inner ring 161 and the outer ring 162 may be substantially parallel to the rotation axis of the first actuator 112. That is, the inner ring 161 and the outer ring 162 may be substantially perpendicular to the upper surface of the conditioning disk 116. Further, the inner ring 161 and the outer ring 162 may be parallel to each other. For example, as illustrated in FIG. 2, the inner ring 161 may extend continuously on the second lower plate 152 and around the second inner upper plate 154, and the outer ring 162 may extend continuously on the second lower plate 152 and around the inner ring 161. The inner ring 161 and the outer ring 162 may be spaced apart from each other in the radial direction of the first and second fixing members 140 and 150, and the internal space 169 may be between the inner and outer rings 161 and 162.

The upper combining portion 163 may be extended from upper ends of the inner ring 161 and the outer ring 162 in the horizontal direction, e.g., in the radial direction. The upper combining portion 163 may be received in the first receiving groove 143 of the first fixing member 140. Each of the upper combining protrusions 164 may be downwardly protruded from edge portions of a lower surface of the upper combining portion 163. The upper combining protrusions 164 may be inserted into the first combining grooves 145 of the first fixing member 140. For example, as illustrated in FIG. 2, the upper combining portion 163 with the upper combining protrusions 164 may be integral with each other to fill the first receiving groove 143 with the first combining grooves 145, respectively.

The lower inner combining portion 165 may be extended from a lower end of the inner ring 161 toward a center point of the flexible connection member 160 in the horizontal direction, e.g., in the radial direction. The lower inner combining protrusion 167 may be upwardly protruded from an inner upper surface of the lower inner combining portion 165. The lower inner combining protrusion 167 may be inserted into the second inner combining groove 155 of the second inner upper plate 154.

The lower outer combining portion 166 may be extended from a lower end of the outer ring 162 toward an outer surface of the flexible connection member 160 in the horizontal direction, e.g., in the radial direction. The lower outer combining portion 166 may be received in the second receiving groove 153 of the second lower plate 152. The lower outer combining protrusion 168 may be upwardly protruded from an outer upper surface of the lower outer combining portion 166. The lower outer combining protrusion 168 may be inserted into the second outer combining groove 157 of the second outer upper plate 156. For example, as illustrated in FIG. 2, the inner and outer rings 161 and 162 may be integral with the upper combining portion 163 and the upper combining protrusions 164, and with the lower inner and outer combining portion 165 and 166 with their corresponding lower inner and outer combining protrusions 167 and 168.

Referring to FIG. 5, the conditioning disk 116 may not be coplanar, e.g., parallel, with the polishing pad 212 due to assembly tolerances of the conditioner 100. For example, a right portion of the polishing pad 212 may be positioned higher than a left portion of the polishing pad 212 to have a slanted upper surface relative to a ground supporting the conditioner 100, e.g., the polishing pad 212 may be tilted at angle $\alpha$ relative to the ground (e.g., dashed line in FIG. 5). In this case, when the conditioning disk 116 descended by the first actuator 112 toward the polishing pad 212 makes contact with the slanted upper surface of the polishing pad 212, the right portion of the flexible connection member 160 may be contracted, e.g., a bottom of the flexible connection member 160 may be pushed toward the arm unit 120, and the left portion of the flexible connection member 160 may be expanded due to the flexibility of the flexible connection member 160. As a result, the entire lower surface of the conditioning disk 166 may make uniform contact with the upper surface of the polishing pad 212 to be tilted at substantially the same angle $\alpha$ as the polishing pad 212.

In detail, since the flexible connection member 130 may be arranged between the arm unit 120 and the conditioning unit 110, the whole conditioning unit 110 may be tilted with respect to the fixed arm unit 120. That is, the first and second actuators 112 and 114, as well as the conditioning disk 116, may be tilted with respect to the arm unit 120. Therefore, the pressurizing force of the first actuator 112 may be substantially perpendicular to the upper surface of the polishing pad 212 so that a loss of the vertical load applied to the polishing pad 212 from the conditioning disk 116 may be reduced. Further, because the rotation axis of the second actuator 114 may be substantially perpendicular to the tilted upper surface of the polishing pad 212, the conditioning disk 116 may apply a uniform pressure to the polishing pad 212.

Deformations of the flexible connection member 160 having the above-mentioned functions may be buffered by the air in the internal space 169 of the flexible connection member 160. Particularly, the flexible connection unit 130 between the arm unit 120 and the conditioning unit 110 may not directly receive the vertical load of the conditioning unit 110 and the frictional moment between the conditioning disk 116 and the flexible connection unit 130 so that the flexible connection unit 130 may have improved durability with respect to the fatigue failure.

Figure 6:
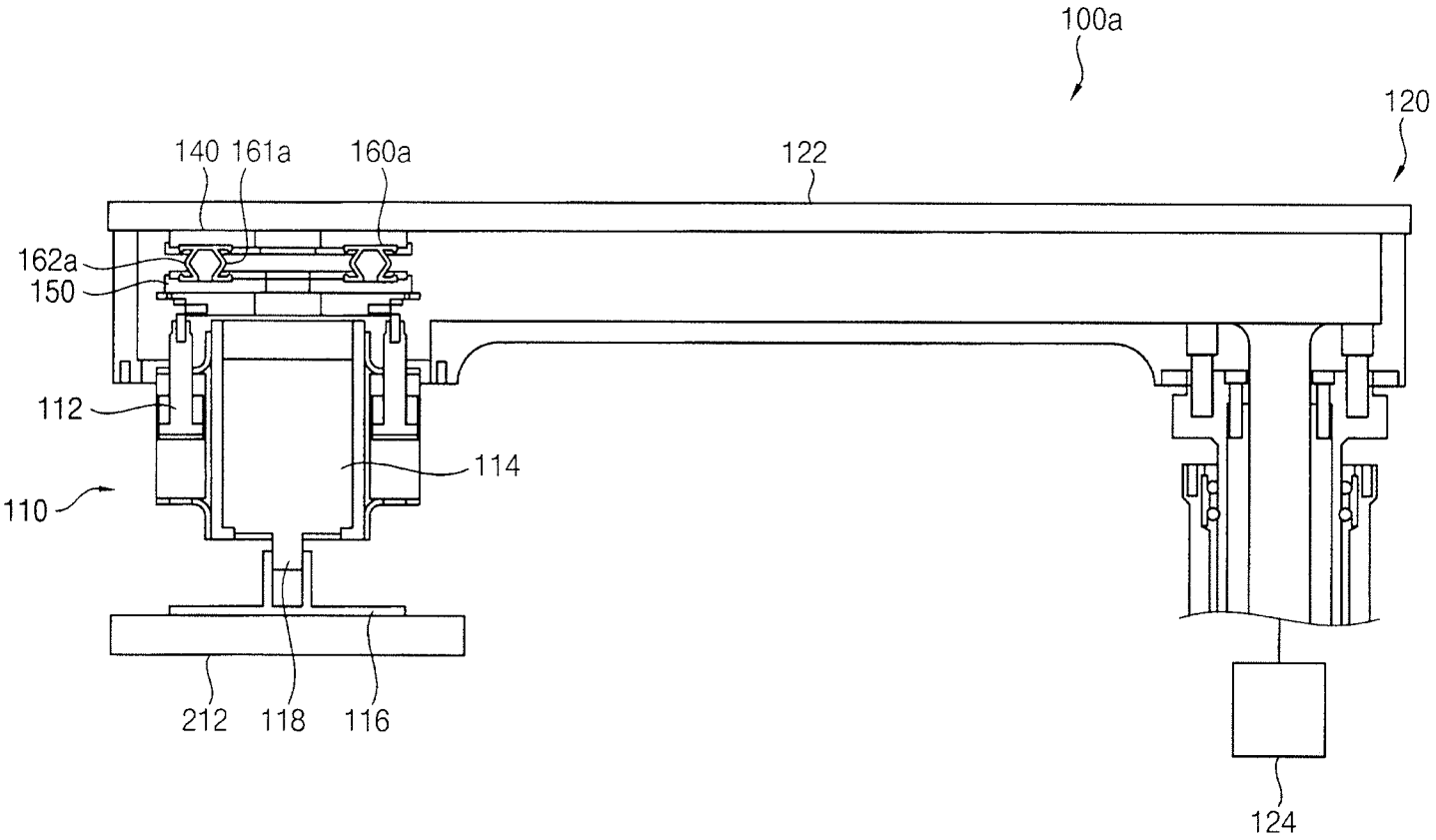
FIG. 6 illustrates a cross-sectional view of a conditioner in accordance with example embodiments.
Figure 7:
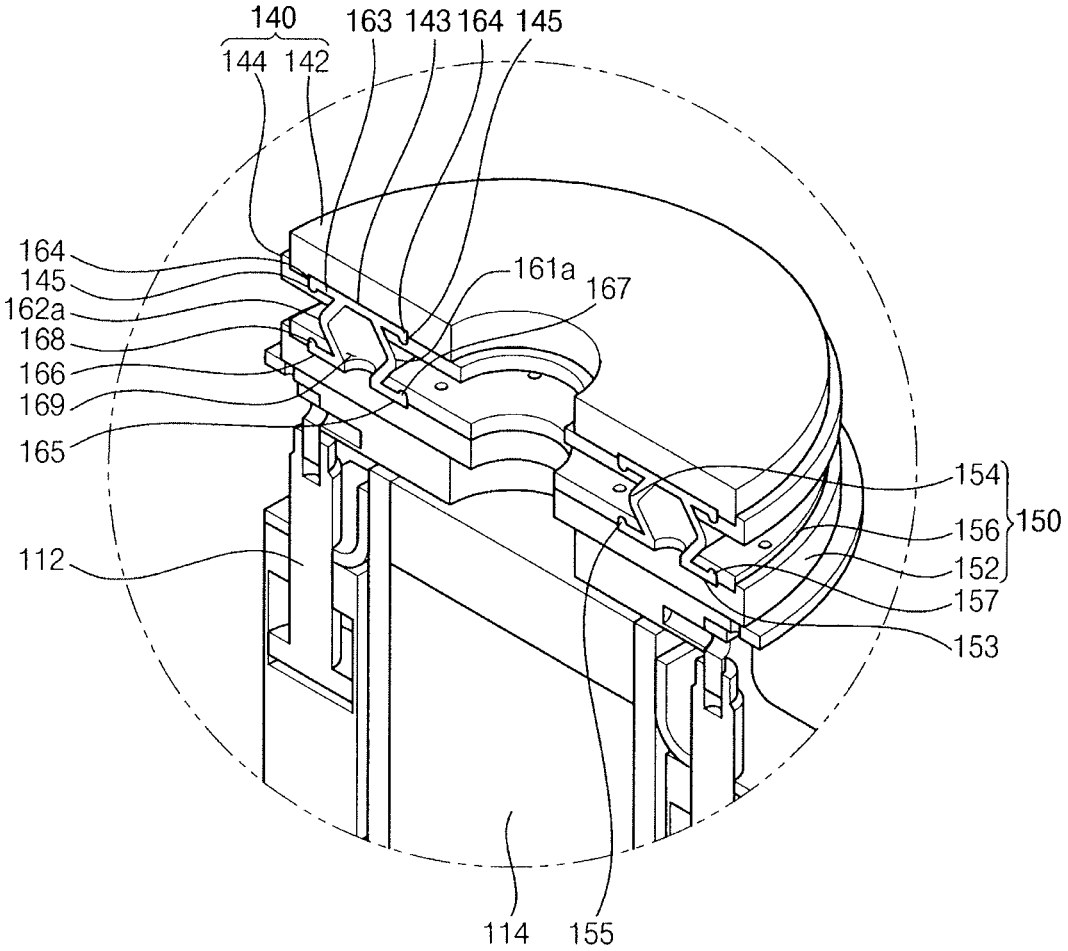
FIG. 7 illustrates an enlarged perspective view of an internal structure of a conditioning unit and a flexible connection unit of the conditioner in FIG. 6.
Figure 8:
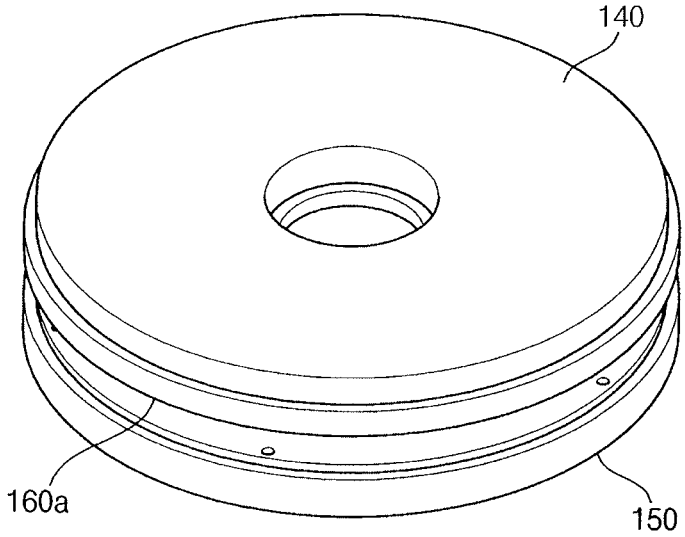
FIG. 8 illustrates a perspective view of the flexible connection unit in FIG. 7.
Figure 9:
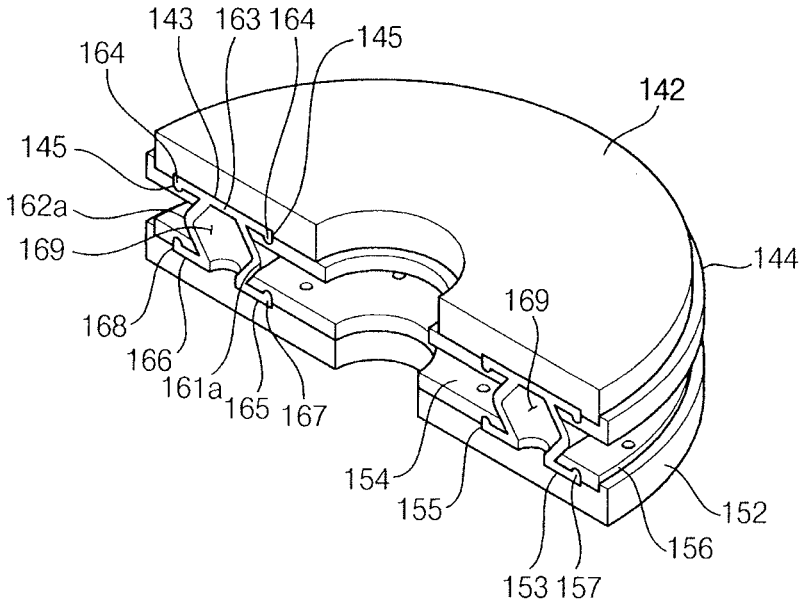
FIG. 9 illustrates a perspective view of an internal structure of the flexible connection unit in FIG. 8.
Figure 10:
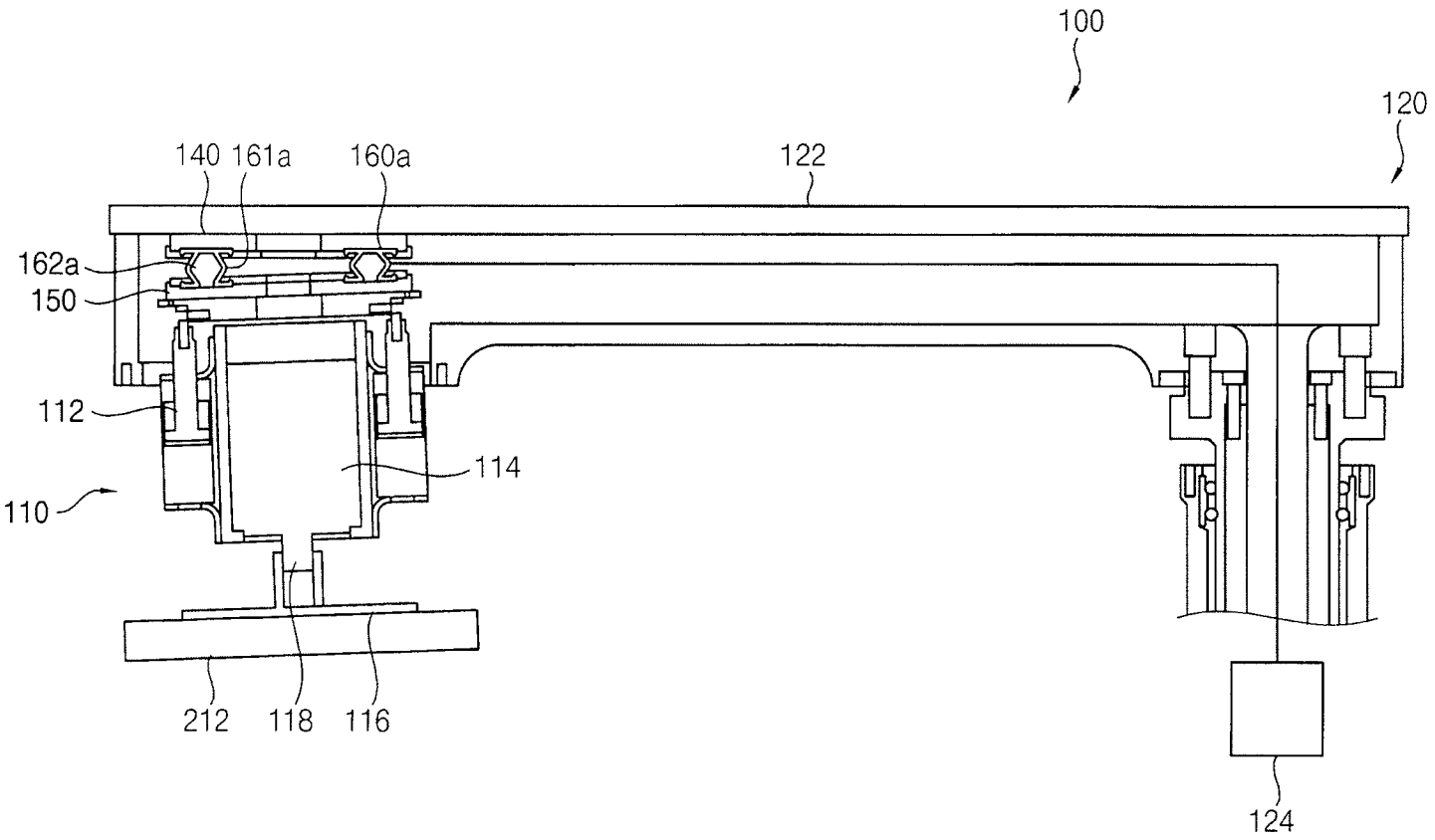
FIG. 10 illustrates a cross-sectional view of operations of the conditioner in FIG. 6.

FIG. 6 is a cross-sectional view illustrating a conditioner in accordance with example embodiments, FIG. 7 is an enlarged perspective view illustrating an internal structure of a conditioning unit and a flexible connection unit of the conditioner in FIG. 6, FIG. 8 is a perspective view illustrating the flexible connection unit in FIG. 7, FIG. 9 is a perspective view illustrating an internal structure of the flexible connection unit in FIG. 8, and FIG. 10 is a cross-sectional view illustrating operations of the conditioner in FIG. 6.

A conditioner 100*a* of this example embodiment may include elements substantially the same as those of the conditioner 100 in FIG. 1 except for a flexible connection member. Thus, the same reference numerals may refer to the same elements and any further illustrations with respect to the same elements may be omitted herein for brevity.

Referring to FIGS. 6 to 10, a flexible connection member 160*a* of this example embodiment may further include a first bent portion 161*a* and a second bent portion 162*a*. The first bent portion 161*a* may be outwardly protruded from the inner ring of the flexible connection member 160*a* in a radius direction. The second bent portion 162*a* may be inwardly protruded from the outer ring of the flexible connection member 160*a* in the radius direction. For example, instead of having sidewalls of the rings of the flexible connection member substantially parallel to each other and perpendicular to the conditioning disk 116 (as illustrated in FIG. 1), the first and second bent portions 161*a* and 162*a* in FIG. 7 may include bent portions that curve away from each other.

When the polishing pad 212 may be tilted with respect to the conditioning disk 116, the flexible connection member 160*a* may be easily deformed by the first and second bent portions 161*a* and 162*a*. Alternatively, the flexible connection member 160*a* may include any one of the first bent portion 161*a* and the second bent portion 162*a*.

Figure 11:
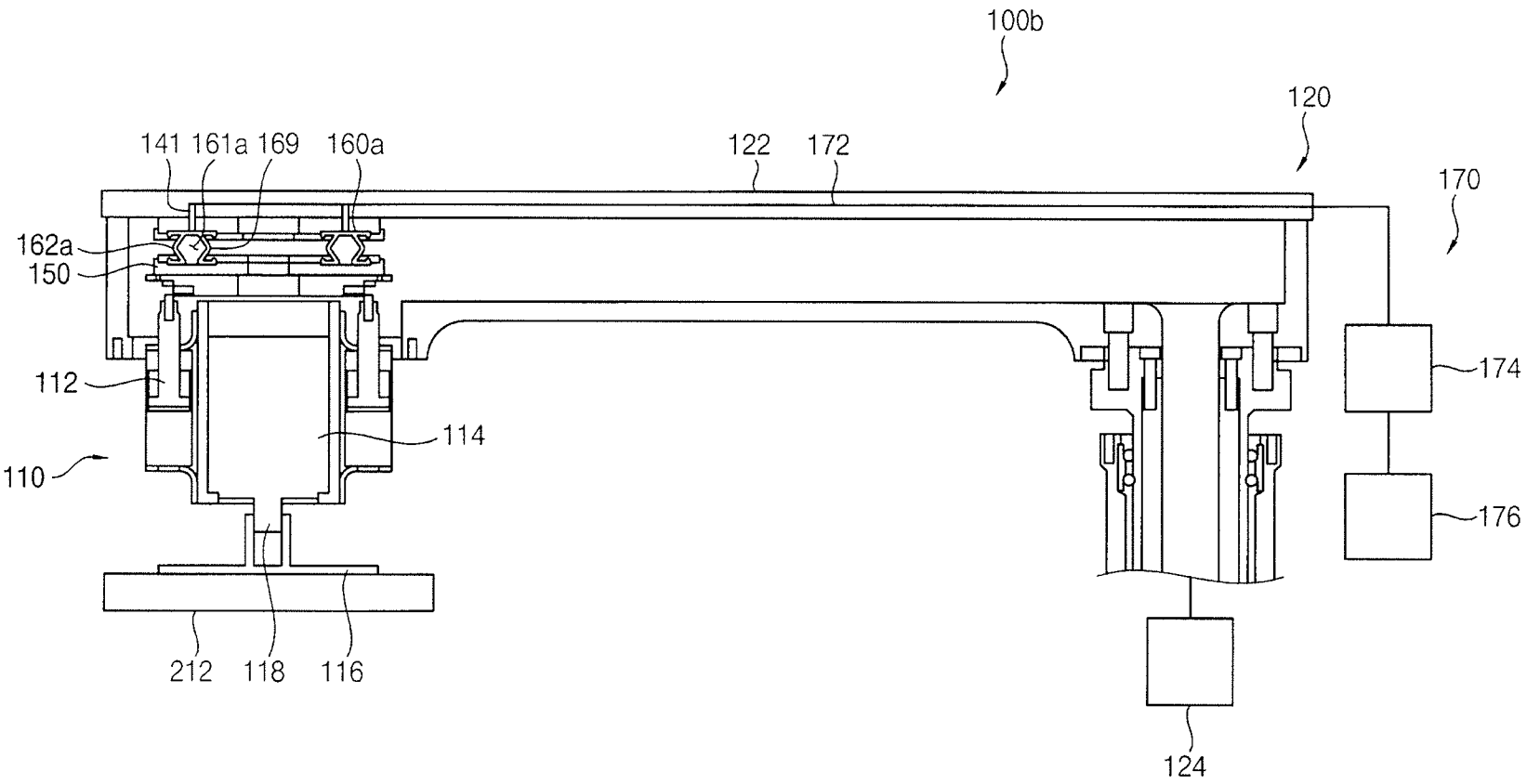
FIG. 11 illustrates a cross-sectional view of a conditioner in accordance with example embodiments.
Figure 12:
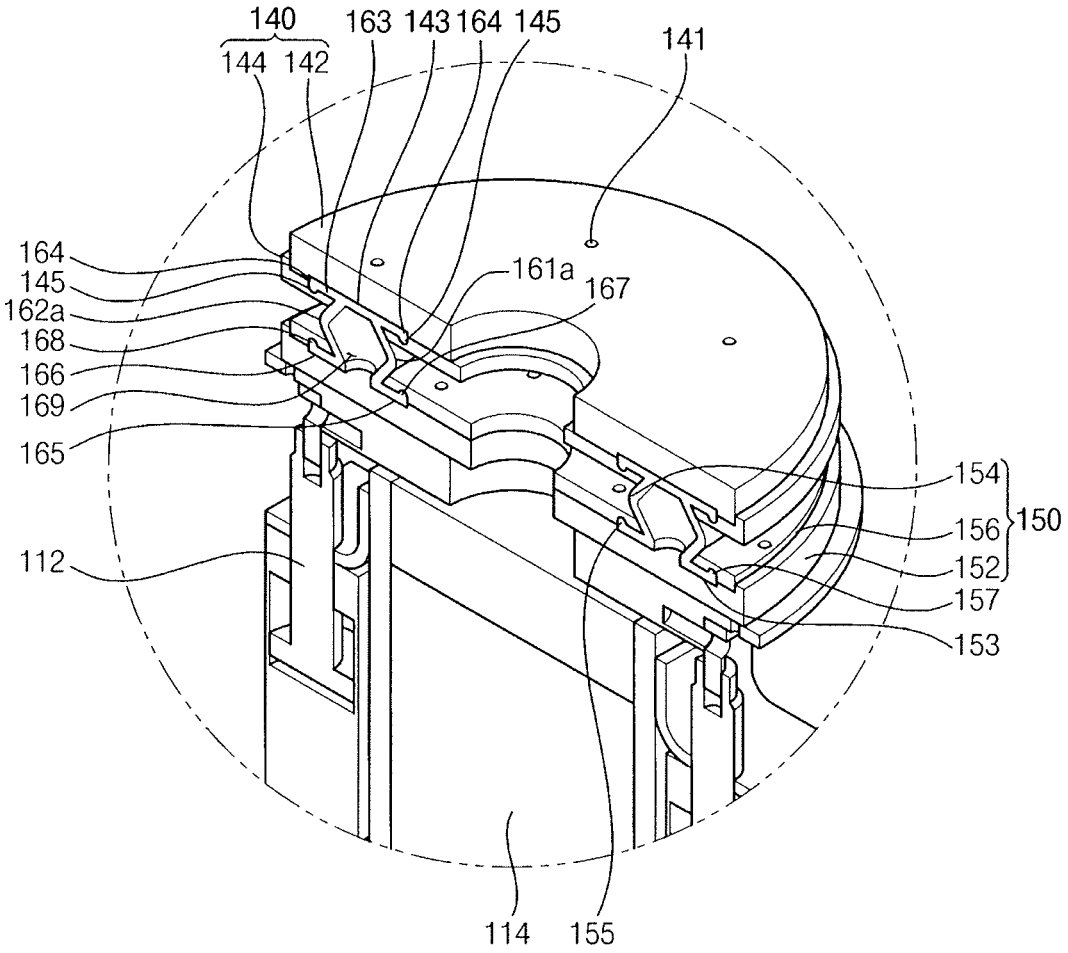
FIG. 12 illustrates an enlarged perspective view of an internal structure of a conditioning unit and a flexible connection unit of the conditioner in FIG. 11.
Figure 13:
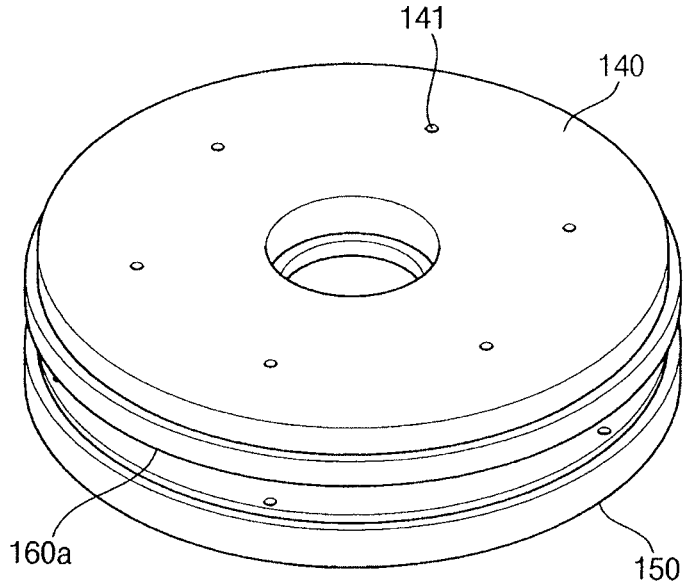
FIG. 13 illustrates a perspective view of the flexible connection unit in FIG. 12.
Figure 14:
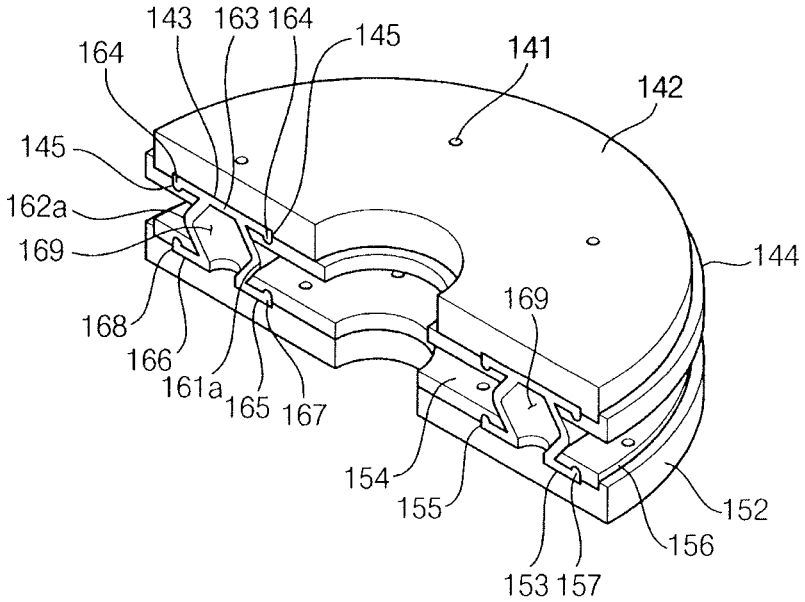
FIG. 14 illustrates a perspective view of an internal structure of the flexible connection unit in FIG. 13.
Figure 15:
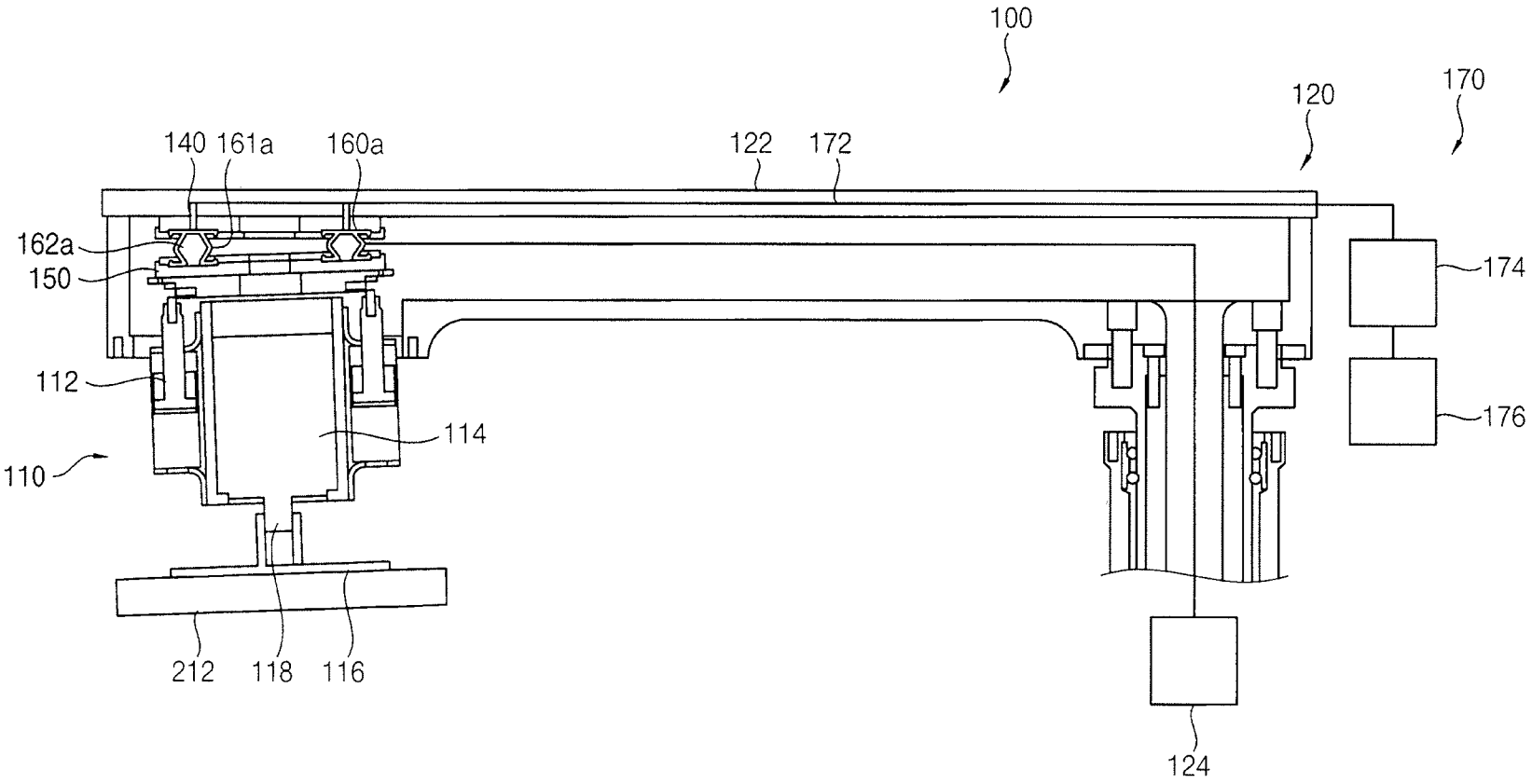
FIG. 15 illustrates a cross-sectional view of operations of the conditioner in FIG. 11.

FIG. 11 is a cross-sectional view illustrating a conditioner in accordance with example embodiments, FIG. 12 is an enlarged perspective view illustrating an internal structure of a conditioning unit and a flexible connection unit of the conditioner in FIG. 11, FIG. 13 is a perspective view illustrating the flexible connection unit in FIG. 12, FIG. 14 is a perspective view illustrating an internal structure of the flexible connection unit in FIG. 13, and FIG. 15 is a cross-sectional view illustrating operations of the conditioner in FIG. 11.

A conditioner 100*b* of this example embodiment may include elements substantially the same as those of the conditioner 100*a* in FIG. 6 except for further including an air-supplying unit, i.e., an air-supplier. Thus, the same reference numerals may refer to the same elements and any further illustrations with respect to the same elements may be omitted herein for brevity.

Referring to FIGS. 11 to 15, a conditioner 100*b* of this example embodiment may further include an air-supplying unit 170. The air-supplying unit 170 may selectively supply air to the internal space 169 of the flexible connection member 160*a*. A pressure of the internal space 169 of the flexible connection member 160*a* may be controlled by a pressure of the air supplied from the air-supplying unit 170. Thus, the flexible connection unit 130 may have stiffness controlled by the air-supplying unit 170.

The air-supplying unit 170 may include an air line 172, a pressure controller 174, and a controller 176. The air line 172 may be connected with the internal space 169 of the flexible connection member 160*a* through air holes 141 in the first fixing member 140. The air line 172 may be extended through the arm 122. The pressure controller 174 may control the air pressure in the air line 172. The controller 176 may transmit a control signal to the pressure controller 174 in accordance with recipes in a CMP process.

According to this example embodiment, the pressure of the air supplied to the flexible connection member 160*a* from the air-supplying unit 170 may be adjusted in accordance with states of the polishing pads 212 to provide the flexible connection unit 130 with proper stiffness. Thus, the conditioning disk 116 may optimally polish the polishing pad 212. Alternatively, the air-supplying unit 170 may be applied to the conditioner 100 in FIG. 1.

Figure 16:
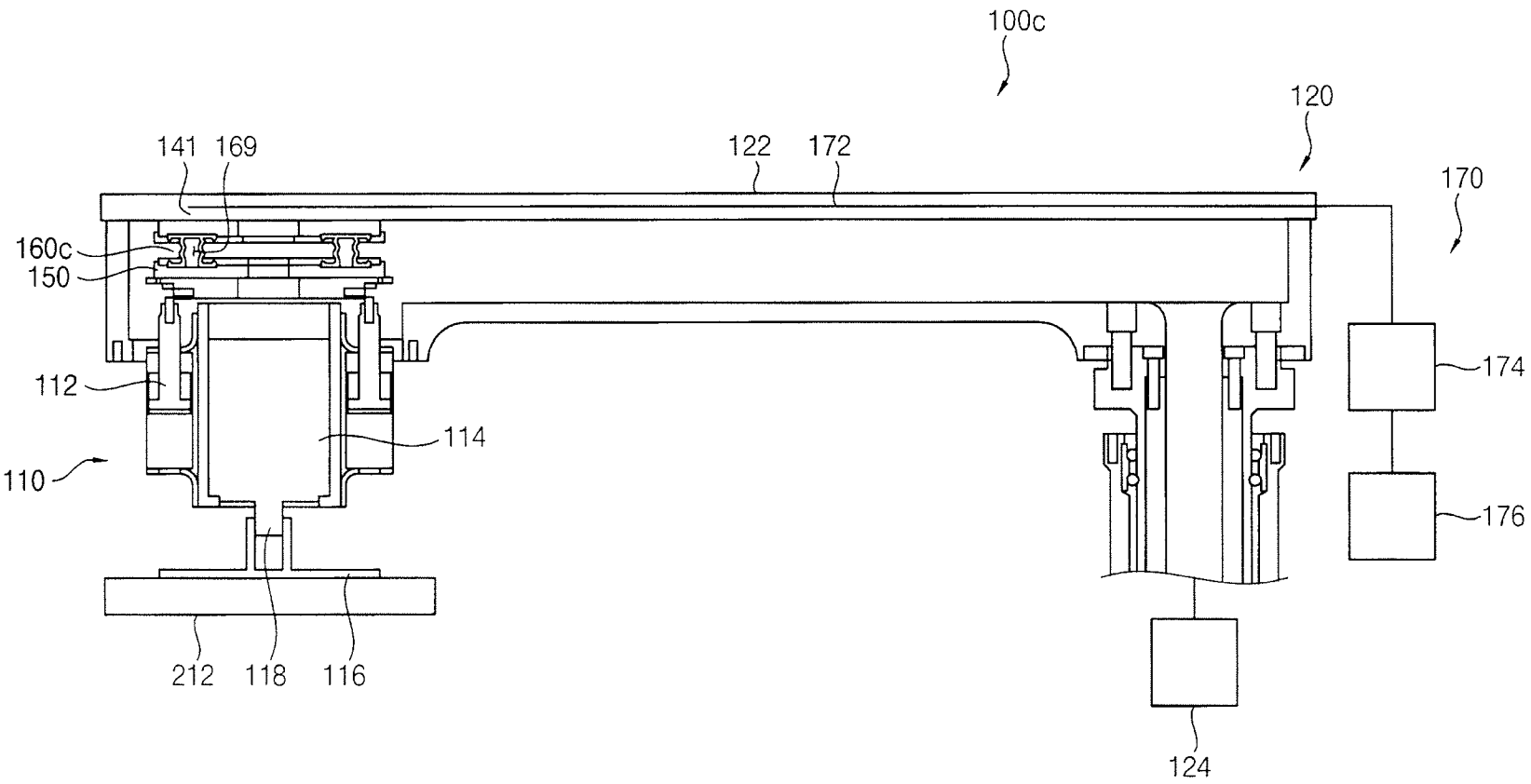
FIG. 16 illustrates a cross-sectional view of a conditioner in accordance with example embodiments.

FIG. 16 is a cross-sectional view illustrating a conditioner in accordance with example embodiments.

A conditioner 100*c* of this example embodiment may include elements substantially the same as those of the conditioner 100*b* in FIG. 11 except for a flexible connection member. Thus, the same reference numerals may refer to the same elements and any further illustrations with respect to the same elements may be omitted herein for brevity.

Referring to FIG. 16, a flexible connection member 160*c* of this example embodiment may include a bellows tube. When the polishing pad 212 may be tilted with respect to the conditioning disk 116, the bellow-shaped flexible connection member 160*c* may be readily deformed. For example, instead of having sidewalls of the rings of the flexible connection member substantially parallel to each other and perpendicular to the conditioning disk 116 (as illustrated in FIG. 1), the flexible connection member 160*c* in FIG. 16 may have bellow-shaped sidewalls.

Figure 17:
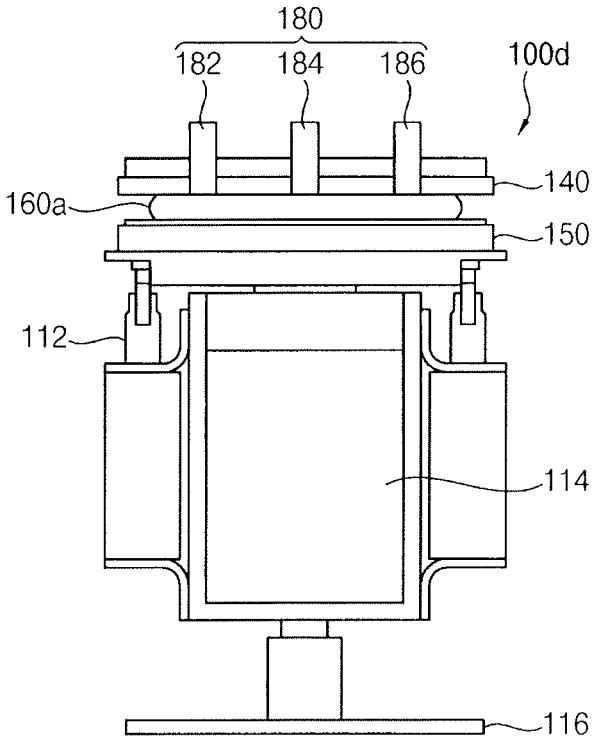
FIG. 17 illustrates a cross-sectional view of a conditioner in accordance with example embodiments.
Figure 18:
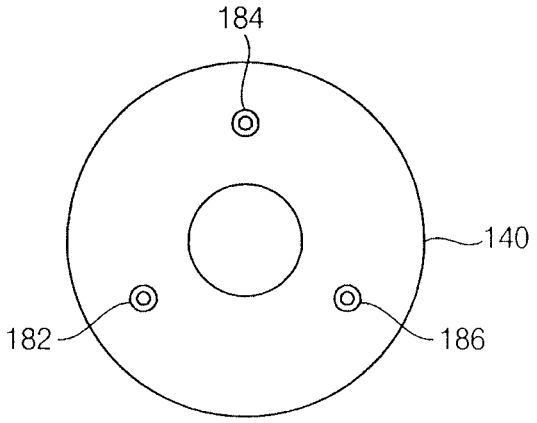
FIG. 18 illustrates a cross-sectional view of a sensor unit of the conditioner in FIG. 17.

FIG. 17 is a cross-sectional view illustrating a conditioner in accordance with example embodiments, and FIG. 18 is a cross-sectional view illustrating a sensor unit of the conditioner in FIG. 17.

A conditioner 100*d* of this example embodiment may include elements substantially the same as those of the conditioner 100*b* in FIG. 11 except for further including a sensor unit. Thus, the same reference numerals may refer to the same elements and any further illustrations with respect to the same elements may be omitted herein for brevity.

Referring to FIGS. 17 and 18, a conditioner 100*d* of this example embodiment may further include a sensor unit 180. The sensor unit 180 may measure a tilted angle of the conditioning unit 110 with respect to the arm unit 120.

The tilted angle of the conditioning unit 110 with respect to the arm unit 120 may correspond to a tilted angle of the second fixing member 150 with respect to the first fixing member 140. Thus, the sensor unit 180 may measure the tilted angle of the second fixing member 150 with respect to the first fixing member 140. The sensor unit 180 may include sensors using electromagnetism, an eddy current, optics, etc.

The sensor unit 180 may include three sensors 182, 184, and 186 arranged on the first fixing member 140. The sensors 182, 184, and 186 may be spaced apart from each other by a uniform gap. The sensors 182, 184, and 186 may measure distances between three points on the first fixing member 140 and corresponding three points on the second fixing member 150. The tilted angle of the second fixing member 150 with respect to the first fixing member 140 may be obtained from the distances between the three points and the corresponding three points. Alternatively, the sensor unit 180 may be applied to the conditioner 100 in FIG. 1 or the conditioner 100*a* in FIG. 6.

Figure 19:
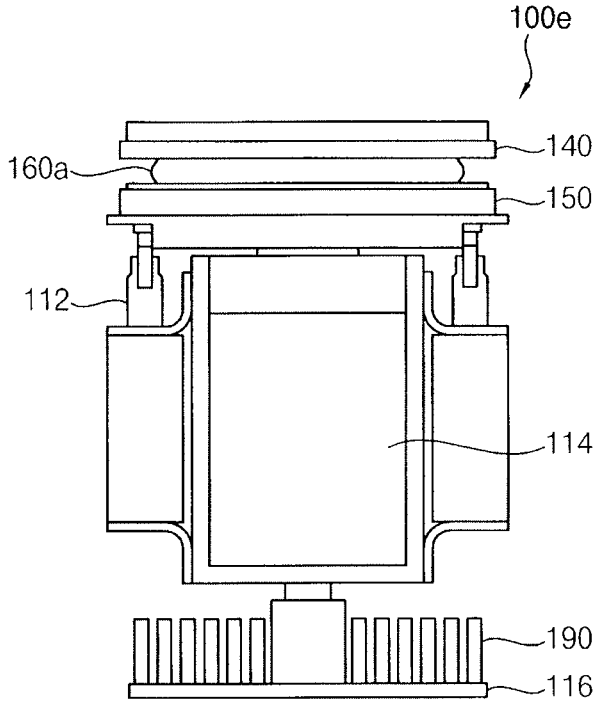
FIG. 19 illustrates a cross-sectional view of a conditioner in accordance with example embodiments.
Figure 20:
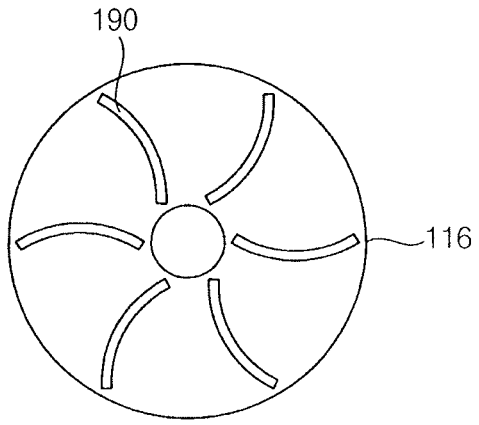
FIG. 20 illustrates a plan view of heat dissipation fins of the conditioner in FIG. 19.

FIG. 19 is a cross-sectional view illustrating a conditioner in accordance with example embodiments, and FIG. 20 is a plan view illustrating heat dissipation fins of the conditioner in FIG. 19.

A conditioner 100*e* of this example embodiment may include elements substantially the same as those of the conditioner 100*b* in FIG. 11 except for further including heat dissipation fins. Thus, the same reference numerals may refer to the same elements and any further illustrations with respect to the same elements may be omitted herein for brevity.

Referring to FIGS. 19 and 20, a conditioner 100*e* of this example embodiment may further include a plurality of heat dissipation fins 190. The heat dissipation fins 190 may be arranged on the upper surface of the conditioning disk 116.

The flexible connection unit 130 may be changed from the position between the second actuator 114 and the conditioning disk 116 into the arm unit 120 and the conditioning unit 110 so that an empty space may be formed over the conditioning disk 116. Thus, the heat dissipation fins 190 may be arranged on the upper surface of the conditioning disk 116 to dissipate heat generated by the friction between the conditioning disk 116 and the polishing pad 212. Further, in order to provide slurry, which may be supplied to the polishing pad 212 in the CMP process, with smooth flow, the heat dissipation fins 190 may be arranged in a spiral shape. Alternatively, the heat dissipation fins 190 may be applied to the conditioner 100 in FIG. 1, the conditioner 100*a* in FIG. 6 or the conditioner 100*d* in FIG. 17.

Figure 21:
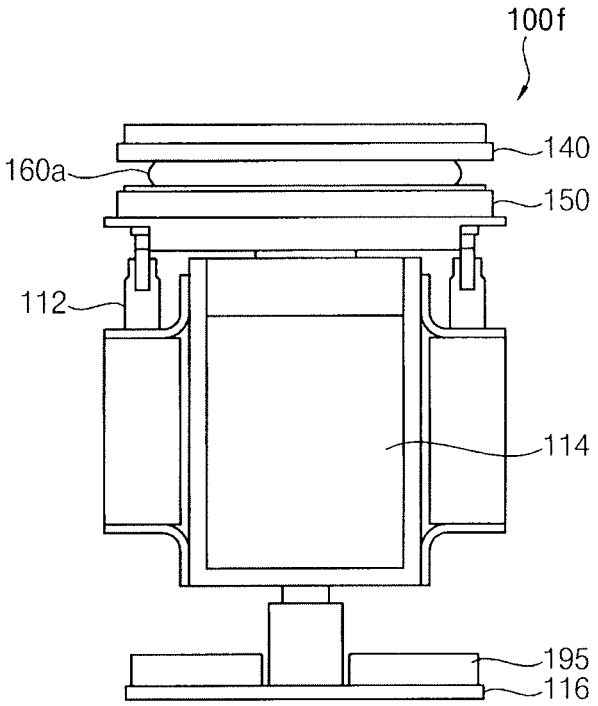
FIG. 21 illustrates a cross-sectional view of a conditioner in accordance with example embodiments.
Figure 22:
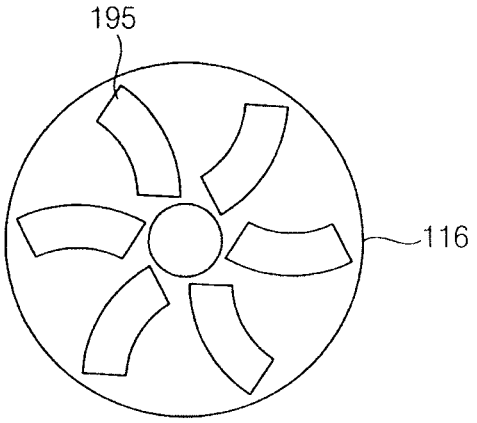
FIG. 22 illustrates a plan view of a heat dissipation pad of the conditioner in FIG. 21.

FIG. 21 is a cross-sectional view illustrating a conditioner in accordance with example embodiments, and FIG. 22 is a plan view illustrating a heat dissipation pad of the conditioner in FIG. 21.

A conditioner 100*f* of this example embodiment may include elements substantially the same as those of the conditioner 100*b* in FIG. 11 except for further including a heat dissipation pad. Thus, the same reference numerals may refer to the same elements and any further illustrations with respect to the same elements may be omitted herein for brevity.

Referring to FIGS. 21 and 22, a conditioner 100*f* of this example embodiment may further include a plurality of heat dissipation pads 195. The heat dissipation pads 195 may be arranged on the upper surface of the conditioning disk 116. The heat dissipation pads 195 may include a material having high heat exchangeable characteristics. Further, in order to provide slurry, which may be supplied to the polishing pad 212 in the CMP process, with smooth flow, the heat dissipation pads 195 may be arranged in a spiral shape. Alternatively, the heat dissipation pads 195 may be applied to the conditioner 100 in FIG. 1, the conditioner 100*a* in FIG. 6 or the conditioner 100*d* in FIG. 17.

Figure 23:
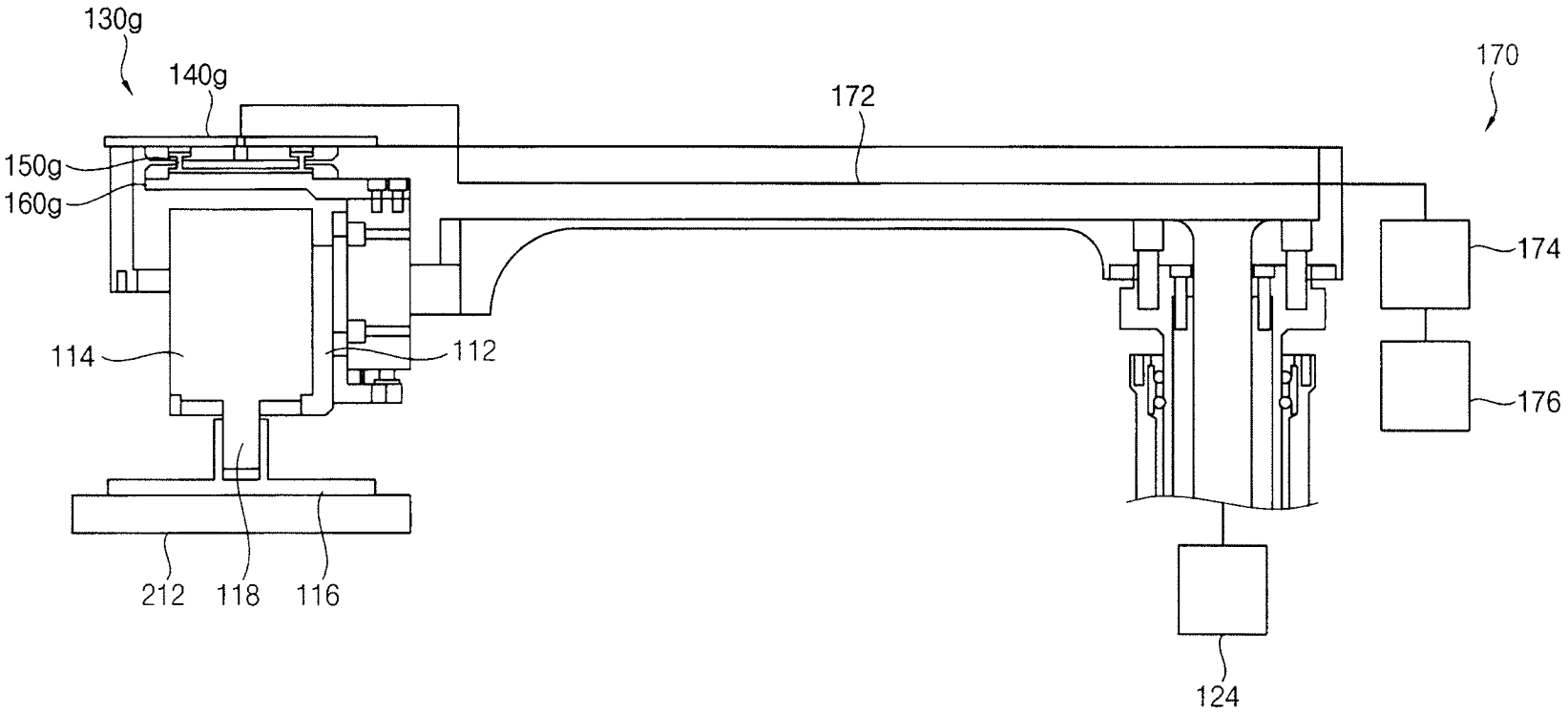
FIG. 23 illustrates a cross-sectional view of a conditioner in accordance with example embodiments.
Figure 24:
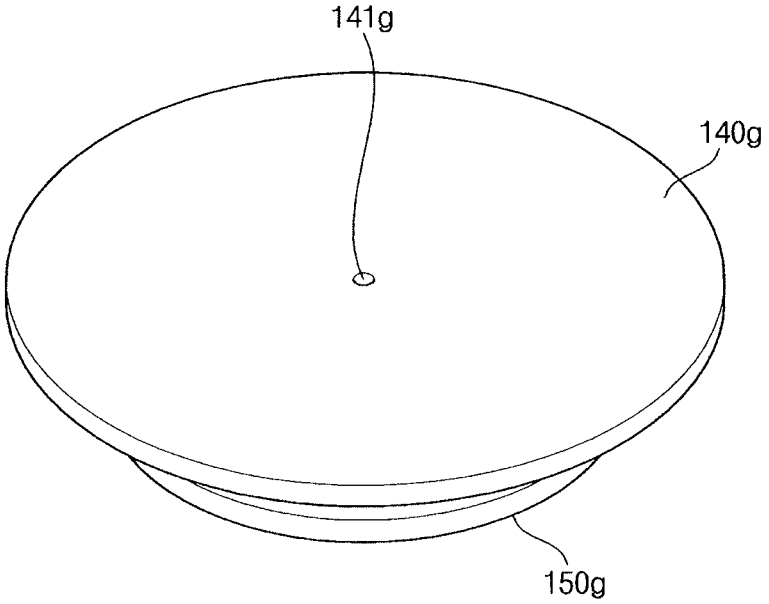
FIG. 24 illustrates a perspective view of the flexible connection unit in FIG. 23.
Figure 25:
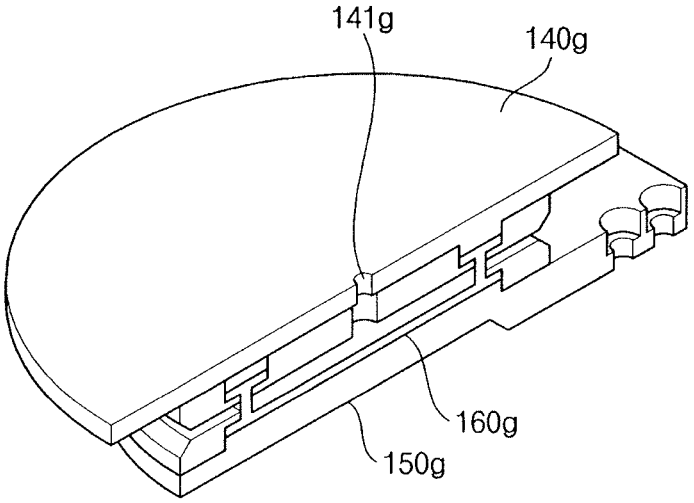
FIG. 25 illustrates a perspective view of an internal structure of the flexible connection unit in FIG. 24.

FIG. 23 is a cross-sectional view illustrating a conditioner in accordance with example embodiments, FIG. 24 is a perspective view illustrating the flexible connection unit in FIG. 23, and FIG. 25 is a perspective view illustrating an internal structure of the flexible connection unit in FIG. 24.

A conditioner 100*g* of this example embodiment may include elements substantially the same as those of the conditioner 100*b* in FIG. 11 except for a flexible connection unit. Thus, the same reference numerals may refer to the same elements and any further illustrations with respect to the same elements may be omitted herein for brevity.

Referring to FIGS. 23 to 25, a flexible connection unit 130*g* of this example embodiment may include a first fixing member 140*g*, a second fixing member 150*g*, and a flexible connection member 160*g*.

The first fixing member 140*g* may have a circular plate shape. An air hole 141*g* may be formed through a central portion of the first fixing member 140*g*. The second fixing member 150*g* may have a circular plate shape.

The flexible connection member 160*g* may be configured to resiliently connect the second fixing member 150*g* with the first fixing member 140*g*. In example embodiments, the flexible connection member 160*g* may include a circular plate having a hollow internal space. The internal space of the flexible connection member 160*g* may be connected to the air hole 141*g*. Thus, the air from the air-supplying unit 170 may be supplied to the internal space of the flexible connection member 160*g* through the air hole 141*g* to provide the flexible connection member 160*g* with an air bag. Alternatively, the flexible connection unit 130*g* may be applied to the conditioner 100 in FIG. 1, the conditioner 100*a* in FIG. 6, the conditioner 100*d* in FIG. 17, the conditioner 100*e* in FIG. 19 or the conditioner 100*f* in FIG. 21.

CMP Apparatus

Figure 26:
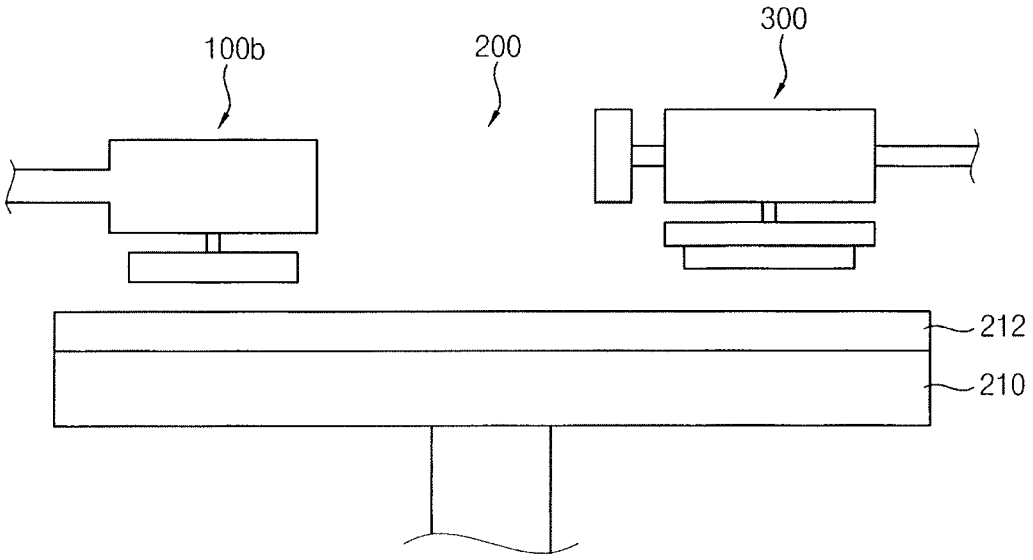
FIG. 26 illustrates a cross-sectional view of a CMP apparatus including the conditioner in FIG. 11.
Figure 27:
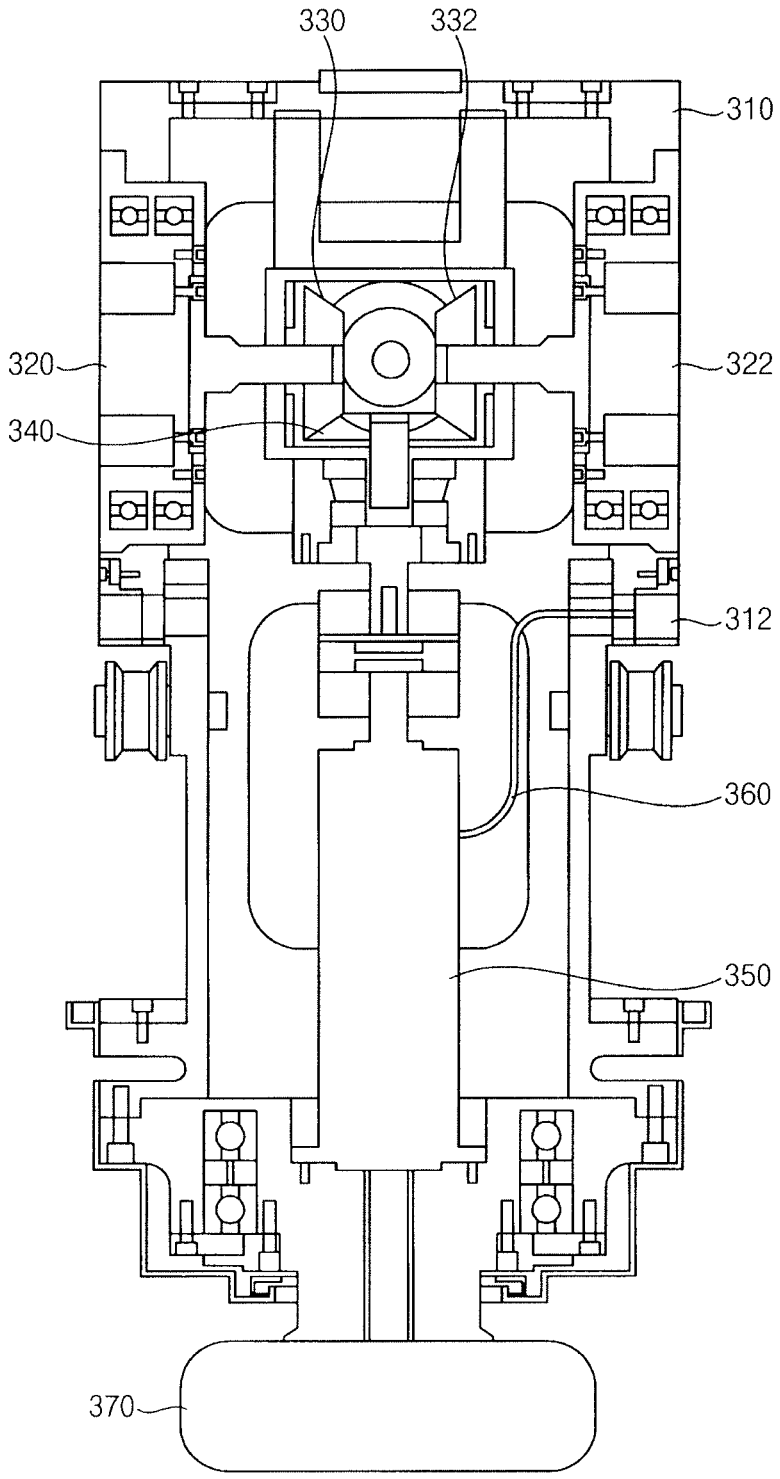
FIG. 27 illustrates a cross-sectional view of a CMP unit of the CMP apparatus in FIG. 26.
Figure 28:
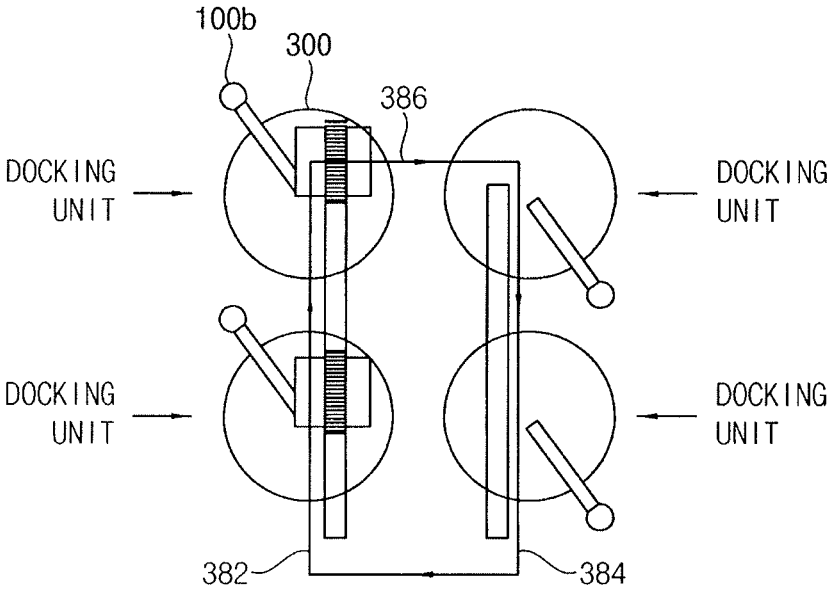
FIGS. 28 and 29 illustrate plan views of operations of the CMP apparatus in FIG. 26.
Figure 29:
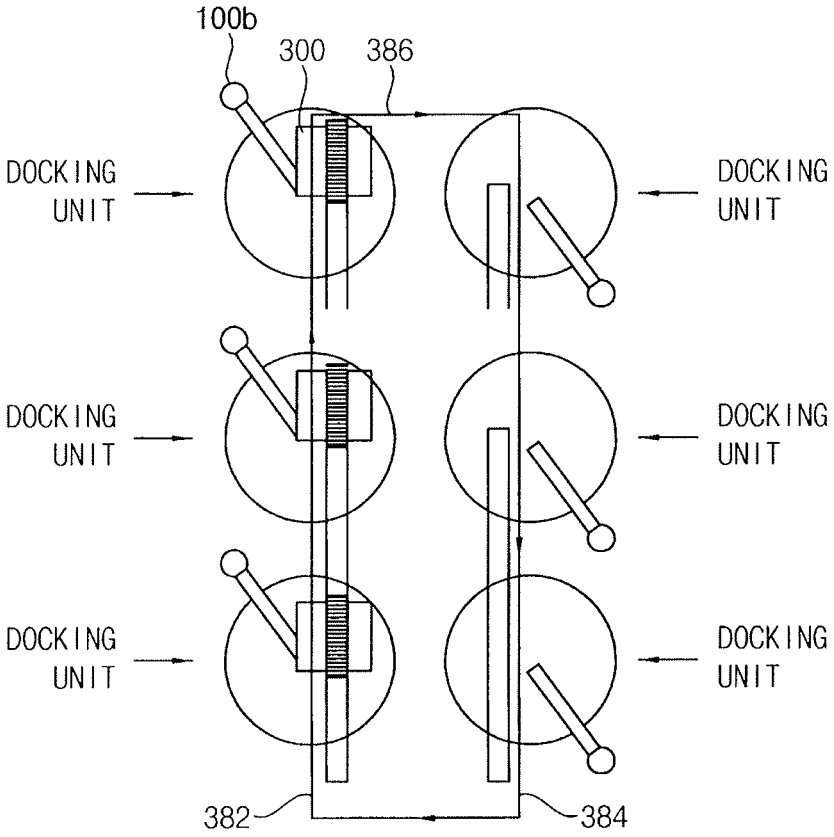

FIG. 26 is a cross-sectional view illustrating a CMP apparatus including the conditioner in FIG. 11, FIG. 27 is a cross-sectional view illustrating a CMP unit of the CMP apparatus in FIG. 26, and FIGS. 28 and 29 are plan views illustrating operations of the CMP apparatus in FIG. 26.

Referring to FIGS. 26 and 27, a CMP apparatus 200 of this example embodiment may include a platen 210, a CMP unit 300, and the conditioner 100*b*.

In example embodiments, the conditioner 100*b* of this example embodiment may include elements substantially the same as those of the conditioner 100*b* in FIG. 11. Thus, the same reference numerals may refer to the same elements and any further illustrations with respect to the same elements may be omitted herein for brevity. Alternatively, the CMP apparatus 200 may include the conditioner 100 in FIG. 1, the conditioner 100*a* in FIG. 6, the conditioner 100*d* in FIG. 17, the conditioner 100*e* in FIG. 19, the conditioner 100*f* in FIG. 21, or the conditioner 100*g* in FIG. 23.

The polishing pad 212 may be placed on an upper surface of the platen 210. As shown in FIG. 28 or FIG. 29, the platen 210 may be in plural. Thus, a plurality of the polishing pads 212 may be placed on the platens 210.

The CMP unit 300 may polish the substrate using the polishing pad 212 and the slurry. The CMP unit 300 may include a housing 310, a spindle unit, a pneumatic line 360, and a substrate holder 370. The spindle unit may include a first coupler 320, a second coupler 322, a first driving bevel gear 330, a second driving bevel gear 332, a driven bevel gear 340, and a rotary union 350.

The housing 310 may have at least two docking faces. Docking units, which may provide the substrate on the substrate holder 370 with a rotary force and a pressure, may be selectively combined with the docking faces of the housing 310. In example embodiments, the housing 310 may have a first docking face and a second docking face. Thus, a first docking unit may be selectively combined with the first docking face and a second docking unit may be selectively combined with the second docking face.

The first coupler 320 may be arranged at the first docking face of the housing 310. The first docking unit may be combined with the first docking face of the housing 310 via the first coupler 320. The first coupler 320 may include a magnetic coupler.

The second coupler 322 may be arranged at the second docking face of the housing 310. The second docking unit may be combined with the second docking face of the housing 310 via the second coupler 322. The second coupler 322 may include a magnetic coupler.

The first driving bevel gear 330 may be connected to the first coupler 320. The first driving bevel gear 330 may be rotated with respect to the vertical axis by a rotary force transmitted from the first docking unit through the first coupler 320.

The second driving bevel gear 332 may be connected to the second coupler 322. The second driving bevel gear 332 may be rotated with respect to the horizontal axis by a rotary force transmitted from the second docking unit through the second coupler 322. The first driving bevel gear 330 and the second driving bevel gear 332 may not be connected with each other so that the first and second driving bevel gears 330 and 332 may be separately rotated.

The driven bevel gear 340 may be arranged under the first and second driving bevel gears 330 and 332. The driven bevel gear 340 may be engaged with the first and second driving bevel gears 330 and 332. Thus, the driven bevel gear 340 may be rotated with respect to the vertical axis by the rotation of any one of the first and second driving bevel gears 330 and 332. That is, the driven bevel gear 340 may convert the horizontal rotary force of any one of the first and second driving bevel gears 330 and 332 into the vertical rotary force.

The rotary union 350 may be connected to the driven bevel gear 340. The rotary union 350 may be rotated with respect to the vertical axis by the driven bevel gear 340.

The substrate holder 370 may be connected to a lower end of the rotary union 350. The substrate holder 370 may be rotated with respect to the vertical axis by the rotary union 350. Thus, the rotating substrate on the substrate holder 370 may make contact with the polishing pad 212.

The housing 310 may include a pneumatic port 312. The pneumatic port 312 may be connected to the rotary union 350 through the pneumatic line 360. Thus, a pneumatic pressure may be transferred to the substrate holder 370 through the pneumatic line 360 and the rotary union 350. The substrate on the substrate holder 370 may pressurize the polishing pads 212.

Referring to FIG. 28, the two platens 210 may be arranged on a first row and a second row. A first guide rail 382 may be arranged over the first row. A second guide rail 384 may be arranged over the second row. A connection rail 386 may be connected between the first guide rail 382 and the second guide rail 384.

The first docking unit may be combined with the first coupler 320 at the first docking face. The rotary force generated from the first docking unit may be transmitted to the substrate holder 370 through the first driving bevel gear 330, the driven bevel gear 340, and the rotary union 350. Further, the pneumatic pressure may be transferred to the substrate holder 370 through the pneumatic port 312, the pneumatic line 360, and the rotary union 350. The CMP unit 300 may receive the rotary force and the pressure from the first docking unit. The CMP unit 300 may be moved along the first guide rail 382. Thus, the substrate on the substrate holder 370 may be polished by the polishing pads 212 on the platens 210 in the first row.

The CMP unit 300 may be moved to the second guide rail 384 through the connection rail 386. The second docking unit may be combined with the second coupler 322 at the first docking face. The rotary force generated from the second docking unit may be transmitted to the substrate holder 370 through the second driving bevel gear 332, the driven bevel gear 340, and the rotary union 350. Further, the pneumatic pressure may be transferred to the substrate holder 370 through the pneumatic port 312, the pneumatic line 360, and the rotary union 350. The CMP unit 300 may receive the rotary force and the pressure from the second docking unit. The CMP unit 300 may be moved along the second guide rail 384. Thus, the substrate on the substrate holder 370 may be polished by the polishing pads 212 on the platens 210 in the second row. As a result, the four CMP processes may be performed on the single substrate.

Referring to FIG. 29, the CMP unit 300 may be applied to the three platens 210 on the first row and the second row. In this case, the six CMP processes may be performed on the single substrate.

Method of Manufacturing a Semiconductor Device

Figure 30:
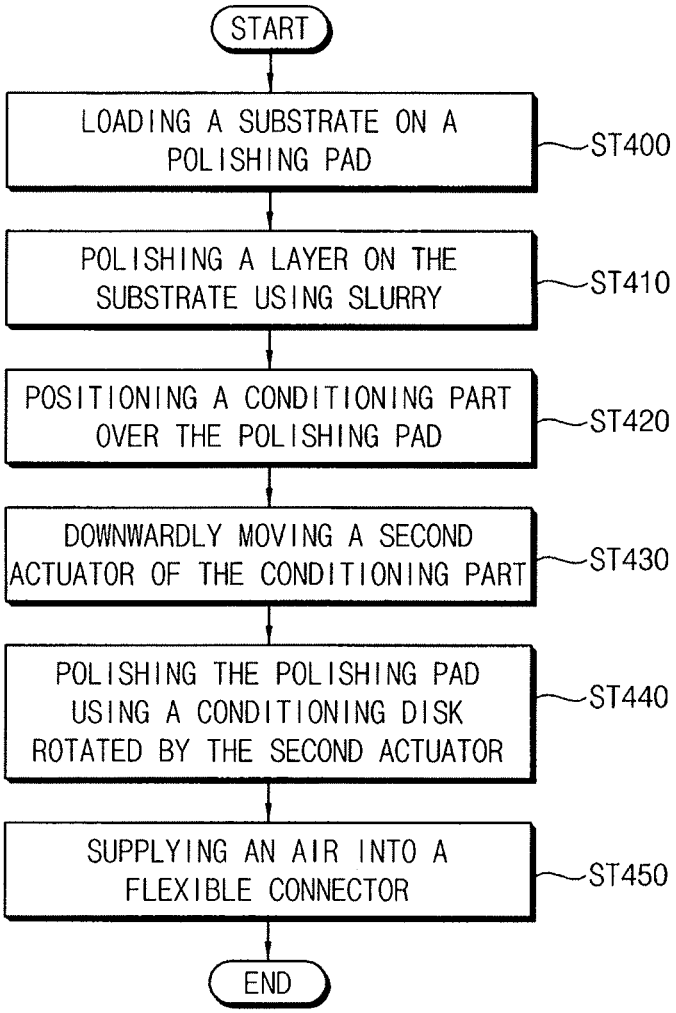
FIG. 30 illustrates a flow chart of a method of manufacturing a semiconductor device using the CMP apparatus in FIG. 26.

FIG. 30 illustrates a flow chart of a method of manufacturing a semiconductor device using the CMP apparatus in FIG. 26.

Referring to FIGS. 26 and 30, in step ST400, a substrate may be arranged on the polishing pad 212.

In step ST410, the CMP unit 300 may polish a layer on the substrate using the polishing pad with supplying slurry on the substrate.

In step ST420, the arm unit 120 may rotate the conditioning unit 110 to position the conditioning unit 110 over a region of the polishing pad to be polished.

In step S1430, the first actuator 112 of the conditioning unit 110 may downwardly move the second actuator 114.

In step ST440, the second actuator 114 may rotate the conditioning disk 116. Thus, the conditioning disk 116 may make contact with an upper surface of the polishing pad 212, while rotating, to polish the upper surface of the polishing pad 212.

During the conditioning operation, the flexible connection unit 130 may allow a relative movement of the conditioning unit 110 with respect to the arm unit 120. Thus, the first and second actuators 112 and 114, as well as the conditioning disk 116, may be tilted with respect to the arm unit 120. Therefore, the pressurizing force of the first actuator 112 may be substantially perpendicular to the upper surface of the polishing pad 212 so that a loss of the vertical load applied to the polishing pad 212 from the conditioning disk 116 may be reduced. Further, because the rotation axis of the second actuator 114 may be substantially perpendicular to the tilted upper surface of the polishing pad 212, the conditioning disk 116 may apply a uniform pressure to the polishing pad 212.

In step ST450, during the conditioning operation, the air-supplying unit 170 may selectively supply air to the internal space 169 of the flexible connection member 160*a*. A pressure of the internal space 169 of the flexible connection member 160*a* may be controlled by a pressure of the air supplied from the air-supplying unit 170. Thus, the flexible connection unit 130 may have stiffness controlled by the air-supplying unit 170.

As a result, a semiconductor device including the layer polished by the optimal polishing pad 212 may be manufactured. Because the polished layer of the semiconductor device may have uniform flatness, following processes for manufacturing the semiconductor device may be optimally applied to the polished layer.

By way of summation and review, a flexible connection unit of a conditioning unit may be arranged between a motor configured to rotate the conditioning disk and the conditioning disk. The flexible connection unit may directly receive a vertical load of the conditioning unit and a frictional moment between the conditioning disk and the flexible connection unit so that the flexible connection unit may be prone to a fatigue failure. Further, because only the conditioning disk may contact the inclined polishing pad, a vertical load loss of the conditioning unit may be generated, thereby causing poor conditioning performance.

In contrast, example embodiments provide a conditioner having improved conditioning performance. Example embodiments also provide a CMP apparatus including the above-mentioned conditioner.

That is, according to example embodiments, the flexible connection unit may be arranged between the arm unit and the conditioning unit so that the flexible connection unit may not directly receive a vertical load of the conditioning unit and a frictional moment between a rotating conditioning disk and the flexible connection unit. Thus, the flexible connection unit may have improved durability with respect to a fatigue failure. Particularly, because the flexible connection unit may form an air bag between the arm unit and the conditioning unit, pressure loss applied to the polishing pad from the conditioning unit may be reduced. Further, the air bag may buffer deformations of the flexible connection unit, thereby improving conditioning performance and polishing performance to improve overall CMP performance.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A conditioner of a chemical mechanical polishing (CMP) apparatus, the conditioner comprising:
- a conditioning unit to polish a polishing pad;
- an arm having a first end and a second end, the first end allowing the arm to pivot about a first axis, the conditioning unit connected to the second end and rotatable about a second axis that is offset from the first axis; and
- a flexible connection unit connecting the conditioning unit with the second end of the arm, the flexible connection unit being moveable to allow relative tilting movements about the second axis of the conditioning part with respect to the arm, and the flexible connection unit including:
  - a first fixing member fixed to the second end of the arm,
  - a second fixing member fixed to the conditioning unit, and
  - a flexible connection member connected between the first fixing member and the second fixing member, the flexible connection member including:
    - an inner ring extending between and contacting the first fixing member and the second fixing member, and
    - an outer ring extending between and contacting the first fixing member and the second fixing member, the outer ring being radially spaced apart from the inner ring and completely surrounding the inner ring.

2. The conditioner as claimed in claim 1, wherein the flexible connection member further includes an internal space between the inner ring and the outer ring, the internal space defining an air bag with a ring shape.

3. The conditioner as claimed in claim 1, wherein the flexible connection member includes a bent portion in a sidewall thereof.

4. The conditioner as claimed in claim 2, further comprising an air-supplier to supply air into the internal space.

5. The conditioner as claimed in claim 4, wherein the air-supplier includes:
- an air line connected to the internal space of the flexible connection member; and
- a pressure controller to control a pressure of the air in the air line.

6. The conditioner as claimed in claim 5, wherein the air line is connected to the internal space through an air hole in the first fixing member.

7. The conditioner as claimed in claim 6, wherein the air line is within the arm.

8. The conditioner as claimed in claim 1, further comprising a sensor to measure a tilted angle of the conditioning unit with respect to the arm.

9. The conditioner as claimed in claim 8, wherein the sensor includes at least three sub-sensors arranged at the first fixing member to measure relative distances between the first fixing member and the second fixing member.

10. The conditioner as claimed in claim 1, wherein the flexible connection member includes upper and lower combining protrusions, and the first and second fixing members include upper and lower combining grooves to receive the upper and lower combining protrusions, respectively.

11. The conditioner as claimed in claim 1, wherein the conditioning unit includes:
- a conditioning disk to polish the polishing pad;
- a first actuator to rotate the conditioning disk; and
- a second actuator connected with the flexible connection unit to lift the first actuator.

12. The conditioner as claimed in claim 11, wherein the conditioning unit further includes a heat dissipation member arranged on the conditioning disk.

13. The conditioner as claimed in claim 1, further comprising a third actuator to rotate the arm with the flexible connection unit.

14. A chemical mechanical polishing (CMP) apparatus, comprising:
- a plurality of platens including polishing pads;
- a CMP part arranged over the platens to polish a substrate; and
- a conditioner including:
  - a conditioning unit to polish a polishing pad of the polishing pads,
  - an arm having a first end and a second end, the first end allowing the arm to pivot about a first axis, the conditioning unit connected to the second end and rotatable about a second axis that is offset from the first axis, and a flexible connection unit connecting the conditioning unit with the second end of the arm, the flexible connection unit being moveable to allow relative titling movements about the second axis of the conditioning part with respect to the arm, and the flexible connection unit including:

a first fixing member fixed to the second end of the arm, a second fixing member fixed to the conditioning unit, and a flexible connection member connected between the first fixing member and the second fixing member, the flexible connection member including:

an inner ring extending between and contacting the first fixing member and the second fixing member, and an outer ring extending between and contacting the first fixing member and the second fixing member, the outer ring being radially spaced apart from the inner ring and completely surrounding the inner ring.

15. The CMP apparatus as claimed in claim 14, wherein the CMP part includes:

a substrate holder to hold the substrate; and a spindle unit including at least two docking faces selectively combined with at least two docking units to transmit a rotary force and a pressure from the docking units to the substrate holder.

16. The CMP apparatus as claimed in claim 15, wherein the spindle unit includes:

at least two couplers connected with the docking units;

driving bevel gears connected with the couplers;

a driven bevel gear engaged with the driving bevel gears; and a rotary union arranged between the driven bevel gear and the substrate holder to transmit the rotary force to the substrate holder.

17. The CMP apparatus as claimed in claim 16, wherein the rotary union is connected to a pneumatic line through which the pressure is transferred.

18. The CMP apparatus as claimed in claim 14, wherein the platens are arranged in at least two rows, at least two guide rails for moving the CMP part are arranged in the rows, and a connection rail is connected between the guide rails.

* * * * *